US007582052B2

(12) United States Patent
Waldmann

(10) Patent No.: US 7,582,052 B2
(45) Date of Patent: Sep. 1, 2009

(54) IMPLANTABLE HEARING AID ACTUATOR POSITIONING

(75) Inventor: Bernd Waldmann, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 788 days.

(21) Appl. No.: 11/115,436

(22) Filed: Apr. 27, 2005

(65) Prior Publication Data

US 2006/0247488 A1 Nov. 2, 2006

(51) Int. Cl.
*H04R 25/00* (2006.01)

(52) U.S. Cl. ..... 600/25

(58) Field of Classification Search ..... 600/25; 181/128–137

See application file for complete search history.

(56) References Cited

U.S. PATENT DOCUMENTS

| | | | | |
|---|---|---|---|---|
| 3,752,939 | A | 8/1973 | Bartz | 607/57 |
| 3,902,084 | A | 8/1975 | May, Jr. | 310/8.1 |
| 3,902,085 | A | 8/1975 | Bizzigotti | 310/8.3 |
| 4,428,377 | A | 1/1984 | Zollner et al. | 128/419 |
| 4,441,210 | A | 4/1984 | Hochmair et al. | 455/41 |
| 4,532,930 | A | 8/1985 | Crosby et al. | 128/419 |
| 4,932,405 | A | 6/1990 | Peters et al. | 128/419 R |
| 4,944,301 | A | 7/1990 | Widin et al. | 128/420.6 |
| 4,947,844 | A | 8/1990 | McDermott | 128/421 |
| 4,953,112 | A | 8/1990 | Widin et al. | 364/578 |
| 4,988,333 | A | 1/1991 | Engebretson et al. | 600/25 |
| 4,992,966 | A | 2/1991 | Widin et al. | 364/571.04 |
| 5,024,224 | A | 6/1991 | Engebretson | 128/420.6 |
| 5,061,282 | A | 10/1991 | Jacobs | 623/10 |
| 5,069,210 | A | 12/1991 | Jeutter et al. | 128/420.6 |
| 5,085,628 | A | 2/1992 | Engebretson et al. | 600/25 |
| 5,095,904 | A | 3/1992 | Seligman et al. | 128/420.6 |
| 5,217,011 | A | 6/1993 | Bisch | 128/420.6 |
| 5,282,858 | A | 2/1994 | Bisch et al. | 623/10 |
| 5,522,865 | A | 6/1996 | Schulman et al. | 607/56 |
| 5,531,774 | A | 7/1996 | Schulman et al. | 607/56 |
| 5,553,152 | A | 9/1996 | Newton | 381/68.6 |
| 5,554,096 | A | 9/1996 | Ball | 600/25 |
| 5,569,307 | A | 10/1996 | Schulman et al. | 607/56 |
| 5,571,148 | A | 11/1996 | Loeb et al. | 607/57 |
| 5,601,617 | A | 2/1997 | Loeb et al. | 607/56 |
| 5,603,726 | A | 2/1997 | Schulman et al. | 607/57 |
| 5,609,616 | A | 3/1997 | Schulman et al. | 607/56 |
| 5,624,376 | A | 4/1997 | Ball et al. | 600/25 |
| 5,702,342 | A | 12/1997 | Metzler et al. | 600/25 |
| 5,707,338 | A | 1/1998 | Adams et al. | 600/25 |
| 5,757,930 | A | 5/1998 | Seidemann et al. | 381/60 |
| 5,772,575 | A | 6/1998 | Lesinski et al. | 600/25 |
| 5,776,172 | A | 7/1998 | Schulman et al. | 607/56 |
| 5,776,179 | A | 7/1998 | Ren et al. | 607/137 |
| 5,788,711 | A | 8/1998 | Lehner et al. | 600/25 |
| 5,833,626 | A | 11/1998 | Leysieffer | 600/559 |

(Continued)

*Primary Examiner*—John P Lacyk
(74) *Attorney, Agent, or Firm*—Marsh Fischmann & Breyfogle LLP

(57) ABSTRACT

Methods for assessing a position of an actuator of an implantable hearing aid transducer relative to an auditory component of a patient. According to one aspect of the invention, an implantable hearing aid transducer is located in proximity to the auditory component of the patient. A test signal is provided to the patient to stimulate the auditory component and generate an acoustic response in the ear canal of the patient. The acoustic response is detected and utilized to assess the position of the actuator of the transducer relative to the auditory component.

29 Claims, 14 Drawing Sheets

U.S. PATENT DOCUMENTS 5,842,967 A 12/1998 Kroll ..... 600/25
5,857,958 A 1/1999 Ball et al. ..... 600/25
5,876,425 A 3/1999 Gord et al. ..... 607/56
5,879,283 A 3/1999 Adams et al. ..... 600/25
5,899,847 A 5/1999 Adams et al. ..... 600/25
5,938,691 A 8/1999 Schulman et al. ..... 607/57
5,954,628 A 9/1999 Kennedy ..... 600/25
5,970,795 A 10/1999 Seidmann et al. ..... 733/585
5,991,663 A 11/1999 Irlicht et al. ..... 607/57
5,993,376 A 11/1999 Kennedy ..... 600/25
5,999,856 A 12/1999 Kennedy ..... 607/57
6,001,129 A 12/1999 Bushek et al. ..... 623/10
6,002,966 A 12/1999 Loeb et al. ..... 607/57
6,005,955 A 12/1999 Kroll et al. ..... 381/328
6,077,215 A 6/2000 Leysieffer ..... 600/25
6,118,877 A 9/2000 Lindemann et al. ..... 381/60
6,154,023 A 11/2000 Durand ..... 324/117 R
6,167,138 A 12/2000 Shennib ..... 381/60
6,174,278 B1 1/2001 Jaeger et al. ..... 600/23
6,293,903 B1 9/2001 Kasic, II et al. ..... 600/25
6,342,035 B1 1/2002 Kroll et al. ..... 600/25
6,390,970 B1 5/2002 Muller ..... 600/25
6,398,717 B1 6/2002 Leysieffer et al. ..... 600/25
6,491,622 B1 12/2002 Kasic, II et al. ..... 600/25
6,517,476 B1 2/2003 Bedoya et al. ..... 600/25
6,537,201 B1 3/2003 Kasic, II et al. ..... 600/25
6,540,661 B1 4/2003 Muller ..... 600/25
6,554,762 B2 4/2003 Leysieffer ..... 600/25
6,603,860 B1 8/2003 Taenzer et al. ..... 381/60
6,620,094 B2 9/2003 Miller ..... 600/25
6,705,985 B2 3/2004 Easter et al. ..... 600/25
6,707,920 B2 3/2004 Miller ..... 381/326
6,712,754 B2 3/2004 Miller et al. ..... 600/25
6,726,618 B2 4/2004 Miller ..... 600/25
6,945,999 B2 * 9/2005 Schneider et al. ..... 623/10

* cited by examiner

| CONDITION | ACOUSTICAL READING | ELECTRICAL READING |
|---|---|---|
| NO CONTACT | < 20 | > 0 |
| INDETERMINATE | 20..40 | 0..5 |
| CONTACT | > 40 | < -5 |

FIG.13a

| CONDITION | ACOUSTICAL READING | ELECTRICAL READING |
|---|---|---|
| NO OVERLOAD | ≤ 2 | ≤ 1 |
| INDETERMINATE | 3..4 | 2 |
| OVERLOAD | ≥ 5 | ≥ 3 |

FIG.13b

IMPLANTABLE HEARING AID ACTUATOR POSITIONING

FIELD OF THE INVENTION

The invention is related to the field of hearing aids, and in particular, to methods for assessing an implantable hearing aid transducer actuator position relative to an auditory component of a patient.

BACKGROUND OF THE INVENTION

In the class of hearing aids generally referred to as implantable hearing aids, some or all of various hearing augmentation componentry is positioned subcutaneously on or within a patient's skull, typically at locations proximate the mastoid process. Implantable hearing aids may be generally divided into two sub-classes, namely, semi-implantable and fully implantable. In a semi-implantable hearing aid, components such as a microphone, signal processor, and transmitter may be externally located to receive, process, and inductively transmit an audio signal to implanted components such as a transducer. In a fully implantable hearing aid, typically all of the components, e.g., the microphone, signal processor, and transducer, are located subcutaneously. In either arrangement, an implantable transducer is utilized to stimulate a component of the patient's auditory system to cause or enhance the sensation of sound for a patient.

A number of different types of implantable transducers have been proposed. By way of primary example, such devices include those that utilize a driver, e.g., an electromagnetic or piezoelectric driver, to move an actuator designed to stimulate the ossicular chain of a patient. By way of example, one type of electromechanical transducer includes a driver that moves an actuator positioned to mechanically stimulate the ossicular chain of a patient via axial vibratory movements. (See e.g., U.S. Pat. No. 5,702,342). In this regard, one or more bones of the ossicular chain are made to mechanically vibrate, thereby stimulating the cochlea through its natural input, the oval window. As may be appreciated, the utilization of implantable transducers of the above-noted nature entails surgical positioning of the actuator within the mastoid process of a patient's skull. Such positioning typically requires the insertion of the transducer through a hole drilled in the mastoid process. Then, a distal end of the actuator is located adjacent a desired location along the ossicular chain (e.g., interfaced with the incus) or outside the cochlea to mechanically stimulate the same.

Precise control of the interface between the actuator and the ossicular chain is important, as the axial vibrations are only efficiently communicated when an appropriate interface exists, e.g., preferably a low mechanical bias or "optimal energy transfer" interface," between the actuator and the ossicular chain. Overloading or biasing of the interface can result in damage or degraded performance of the biological aspect (movement of the ossicular chain) as well as degraded performance of the mechanical aspect (movement of the actuator). Similarly, underloading or insufficient engagement between the actuator and the ossicular chain can result in a degraded performance or loss of performance.

In this regard, patients may also experience a "drop-off" in hearing function after implantation due to changes in the physical engagement or interface between the actuator and the ossicular chain due to aspects such as tissue growth. After implantation, however, it is difficult to readily assess the interface between the actuator and ossicular chain without invasive and potentially unnecessary surgery.

SUMMARY OF THE INVENTION

In view of the foregoing, the broad objective of the present invention is to provide one or more methods and systems for assessing the position of an implantable hearing aid actuator relative to an auditory component of a patient. A related object of the present invention is to provide for such assessment during or subsequent to an implant procedure. Another objective of the present invention is to provide for implantable hearing aid actuator performance assessment in a relatively simple and straightforward manner.

The inventive methods and systems provide for transmission of an acoustic test signal to an ear canal of a patient having an implantable hearing instrument. Typically, the implantable hearing instrument includes a transducer that is positioned relative to an auditory component of the patient. A reflected acoustic signal (i.e., acoustic response) is received from the ear canal of the patient and utilized to assess a position of an implanted actuator of the transducer relative to the auditory component of the patient. A position of the actuator may then be assessed using the reflected acoustic signal. The system and method may be utilized to facilitate the positioning of an actuator and an auditory component to facilitate optimal stimulation of the auditory component by the transducer.

In this regard, the inventive method may further include the steps of locating the implantable hearing aid transducer in proximity to the auditory component of the patient, and thereafter, repositioning the actuator relative to the auditory component. In conjunction with repositioning the actuator, the acoustic test signal may be provided and reflected acoustic signals received a number of times to successively assess the position of the actuator relative to the auditory component. According to this characterization, the reflected acoustic signal may be utilized to determine when reflected contact is made between the actuator and the auditory component.

The reflected acoustic response(s) may be utilized to generate an acoustic test measure. Such acoustic test measures may be based on any determinable characteristic of the acoustic test signal and/or reflected acoustic signal. In one instance, the acoustic test measure may be based on a magnitude of the reflected acoustic responses and/or phase of those applied and received signals. For instance, the magnitude of the reflected acoustic response signal may be compared to the magnitude of the applied acoustic test signal that is provided to the ear canal of the patient. Comparison of these magnitudes may, at least in part, define a transfer function between one or more characteristics of a given acoustic test signal and a corresponding reflected acoustic response signal. Likewise, such a transfer function may be defined, at least in part, by phase differences between the applied and received signals. In this regard, it will be noted that the movement of an auditory component caused by repositioning of an actuator may result in, for example, stiffening of the auditory component. Likewise, the stiffened auditory component may more readily reflect applied test signals and, hence, alter the phase of corresponding reflected acoustic response signals.

According to the above features, the present method may include providing a plurality of acoustic test signals to the patient to stimulate the auditory component and cause the auditory component to generate a corresponding plurality of reflected acoustic response signals. Thereafter, analysis of the plurality of reflected acoustic response signals, or at least analysis of one characteristic of the same, may be performed to assess the position of the actuator of the transducer relative to the auditory component. In this regard, such analysis may include, among other things, various comparisons of the plurality of reflected acoustic response signals.

For instance, a comparison of the reflected acoustic response signals, or at least one characteristic of the same, may be made to identify a change, e.g., in the responses, that is caused by a change in the relationship between the actuator and the auditory component. For example, a comparison of the acoustic responses may include comparing a first and second response, the first and third response, the first and fourth response, etc., to identify a change in the acoustic response signals resulting from a change in the relative position between the actuator and auditory component. For instance, if the acoustic response signals are received during the positioning or advancement of the actuator toward the auditory component, the change in the acoustic response signals may be indicative of the point at which the actuator contacts the auditory component. Thereafter, the change in the acoustic response signals may be indicative of the amount of contact therebetween.

In another example, a comparison of acoustic response signals, or at least one characteristic of the same, may include comparing a first and second response, a second and third response, a third and fourth response, etc. to identify a rate of change in the acoustic responses. Again, the rate of change may be utilized to identify a change in the relationship between the auditory component and the actuator, e.g., such as contact and degree of contact.

In another example, a combination of comparisons may be utilized. For instance a comparison of the first and second acoustic response, the first and third acoustic response, etc. may be utilized to determine when contact is made, while a comparison of the first and second, the second and third, etc. may be utilized to determine the degree of contact as a function of the rate of change in the acoustic responses after contact is made.

In any of the above examples, it may be desirable to establish a reference measure/reference response for use as, for example, a threshold comparison value. In one arrangement, obtaining a reference measure may include locating the actuator in an initial position relative to the auditory component of the patient. In this initial position, the actuator may be spaced from the auditory component such that no direct physical contact exists between these members. Accordingly, a test signal may be applied in order to obtain an acoustic reference response from the patient ear canal. This reference response may be indicative of a baseline response of the auditory component prior to actuator interface. As will be appreciated, the actuator may then be moved from the initial position to another position in order to obtain one or more additional acoustic response signals. Accordingly, a change between the acoustic reference response and a subsequently obtained response may indicate, for example, contact between the actuator and the auditory component. Alternatively, predetermined reference/threshold values (e.g., from prior test procedures) may be stored for comparison purposes.

Once the plurality of acoustic response signals and/or reference measurement(s) are obtained, the step of assessing the position of the actuator of the implantable hearing instrument may include calculating a transfer function for each corresponding set of the acoustic test signals and reflected acoustic response signals. Such a transfer function may include, without limitation, a comparison of the magnitude of the acoustic test signal to magnitude of the reflected acoustic response. Such a transfer function may be calculated for each different position of the actuator relative to the auditory component of the patient. As will be appreciated, changes in the transfer function between actuator positions may allow for obtaining a first type of actuator position indication for each position of the actuator relative to the auditory component of the patient. Further, the transfer functions may be compared to predetermined reference data to determine, for example, unloaded, loaded an/or overloaded conditions between the actuator and the auditory component.

Any appropriate acoustic test signal may be transmitted to the ear canal of the patient that will result in the receipt of a reflected acoustic response signal. For instance, the transmitting step may include transmitting a plurality of acoustic test signals at different frequencies across a predetermined frequency range in the ear canal of the patient. Likewise, a corresponding plurality of a reflected acoustic response signals may be received from the ear canal of the patient in response to the plurality of transmitted acoustic signals. Furthermore, it will be appreciated that such a plurality of test signals and responses may be obtained at each of a plurality of different positions of the actuator relative to the auditory component of the patient.

Furthermore, various different forms of acoustic test signals may be utilized according to the present aspect. For instance, some examples of the test signals may include, without limitation, single frequency tones, multiple frequency tones, and swept frequency tones. Furthermore, noise signals may also be utilized.

According to another feature of the present aspect, the system and method may include outputting a first type of actuator position indication to a user. This first type of actuator position indication may be an indication of the position of the actuator as determined by the transmission and receipt of acoustic signals to and from the ear canal of a patient. Such an output may include providing a visual output and/or an auditory output of the first type of actuator position indication. For instance, providing an auditory output may include providing a series of tones to indicate when a desired contact or interface is established between the actuator and the auditory component. In another example, visual output may be generated that provides numerical, textual, graphical or other representation that includes the first type of actuator position indication. In a further example, the visual output may provide the first type of actuator position indication in relation to a range of actuator position indications such that a user may visually gauge, for example, the effectiveness of a current position of the actuator relative to the auditory component of the patient.

In order to receive the reflected acoustic response signal from the ear canal, it may be preferable to position a probe within the ear canal of the patient. Such a probe may operative to both transmit and receive acoustic signals. Furthermore, it may be preferable that the probe may be maintained at a substantially fixed position within the ear canal throughout a procedure for positioning/re-positioning the actuator. That is, when a reference measure taken from the patient for comparison purposes, it will be appreciated that movement of the probe may alter one or more characteristics (e.g., phase and/or magnitude) of a received acoustic signal. Accordingly, movement of the probe after obtaining the reference signal may result reducing the correlation with any subsequently received signals.

In a further embodiment of the present aspect, the inventive system and method includes the obtainment of a second type of an indication of the position of the actuator relative to the auditory component of the patient. This second type of actuator position indication is associated with an electrical signal passing through the actuator of the implantable hearing instrument transducer. In this regard, such an indication associated with the electrical signal may be provided by, without limitation, current measurements, voltage measurements, magnetic field measurements, capacitance measurements, inductance measurements and impedance measurements. Generally, the electrical signal is at least partially related to an amount of current passing through the implanted electromechanical transducer. Such current is inversely related to the electrical impedance present at the transducer, which is in turn directly related to the mechanical impedance present at the interface between the transducer and the auditory component of a patient. As such, the electrical signal may be utilized to assess whether the transducer is operative and whether a desired interface between the actuator and the auditory component of the patient is present. Stated otherwise, measurement of such an electrical signal provides for a measure of the coupling between the actuator and the auditory component of the patient.

In order to measure an electrical signal passing through the actuator of the implantable hearing instrument transducer, the system and method may include applying at least one test drive signal to the implantable hearing aid instrument and obtaining at least one transducer test measure. This transducer test measure is indicative of the electrical signal(s) passing through the actuator in response to the applied test drive signal. Once the test drive signal is applied and the transducer test measure is obtained, the position of the actuator may be evaluated relative to the auditory component using the transducer test measure(s). For instance, one or more transducer test measures may be compared to a transducer reference measure to obtain a second type of actuator position indication. The transducer reference measure may correspond to a value acquired from the application of a reference test drive signal, or, may correspond to a predetermined value (e.g., a known unloaded actuator impedance value). As will be appreciated, the applying of test drive signals and obtaining of transducer test measures may also be performed at multiple positions in accordance with the steps outlined above in relation to obtaining multiple acoustic responses. Further in accordance with the application of acoustic signals, the applying of one or more test drive signals to the implantable hearing instrument may be performed different frequencies, across predetermined frequency ranges and/across swept frequencies.

The second type of actuator position indication may also be output to the user. This second type of actuator position indication may further be provided in conjunction with the first type of actuator position indication. In this regard, a first actuator position indication based on the receipt of an acoustic signal from the ear canal of a patient and a second actuator position indication associated with an electrical signal passing through the actuator are provided. Once such indications are output to a user, the actuator of the implantable hearing instrument may be positioned relative to the auditory component of the patient in conjunction with at least one of the indications.

In carrying out the above objectives, and other objectives, features, and advantages of the present invention, a second aspect is provided which includes a system for assessing the position of an actuator of an implantable hearing instrument transducer relative to an auditory component of a patient. The system includes a first measurement device operative to generate a first output indicative of a position of the actuator based on at least one acoustic signal received from the ear canal of a patient. The system further includes a second measurement device that is operative to generate a second output indicative of the position of the actuator based on a measured electrical signal passing through the transducer and/or actuator of an implanted hearing instrument. This two measurement device system, or combined system, further includes an output device for outputting at least one of the first and second outputs to the user and operating logic for selectively controlling the operation of a first and second measurement devices.

In one example, the firs and second measurement devices of the system may be at least partially housed within a common structure. In such an embodiment, the measurement devices of the combined system may share common components, such as, without limitation processors, storage devices, signal generators, the output device etc. Alternatively, the first and second measurement devices may be stand-alone units that are coupled by, for example, a processing platform that supports the operating logic.

The first measurement device (i.e., the acoustic system) will typically include an acoustic output device for providing an acoustic test signal to the ear canal of a patient and an acoustic signal receiver for receiving at least one reflected acoustic response signal from the ear canal of the patient. As discussed in the first aspect, the acoustic output device and acoustic signal receiver may be housed in a common housing adapted for disposition relative to a patient's ear (e.g., within the ear canal of the patient). It may further include a processor operatively interconnected to the acoustic signal receiver that includes acoustic processing logic for assessing a position of the actuator relative to the auditory component of the patient based on at least one reflected acoustic response signal. The first measurement device may further include a storage device/memory for storing one or more actuator position indications and/or reference/threshold values.

In order to generate signals, the first measurement device may also include a signal generator for generating test signals that may be provided to the acoustic output device. The acoustic output device may then convert the test signals into acoustic outputs.

The second measurement device, or electrical test measure system, may also include positioning logic for evaluating a position of the actuator relative to the auditory component of the patient utilizing the at least one test measure. As will be appreciated, the second system may further include, without limitation a processor(s), signal generator(s), output devices, test signal transmission means, test measurement receipt devices. One of more of such components may be shared with the first measurement system, as discussed above.

The second measurement device will typically also include a test drive device that is operative to provide at least one predetermined test signal for use in generating the electrical signal passing through the transducer. That is, the test drive device is operative to provide an electrical signal that stimulates the actuator and, in some instances, the auditory component of the patient. In one embodiment, the test drive device includes an acoustic output device for providing at least one acoustic signal corresponding to the at least one test signal to a microphone (e.g., an external or subcutaneous microphone) associated with the implantable hearing instrument. In this regard, the implanted hearing device receives an acoustic signal as it would during normal operation and the actuator is stimulated as in normal operation. In order to provide a test measure associated with the electrical signal passing through the actuator, the hearing instrument may include signal measurement logic for use in obtaining the at least one transducer test measure. Further, the hearing instrument may include a transmitter and the second measurement device may include a receiver such that the hearing instrument may transmit the transducer test measure to the measurement system. In another embodiment, the second measurement device includes a wireless audio signal link, consisting of a modulator and transmitter for providing a test signal(s) to a subcutaneous receiver and demodulator operatively interconnected to the implantable hearing instrument. Again, the test signal may be operative to initiate operation of the transducer and actuator of the implanted hearing instrument. Again, a transducer test measure indicative of the electrical signal may be provided to the second measurement device via a transmitter and receiver setup. Alternatively, for the case of a wireless audio signal link consisting of an RF transmitter and inductively coupled subcutaneous receiver, the transducer test measure may be provided via modulation of the inductive coupling between the subcutaneous coil and the coil of the second measurement device. In a further embodiment, the second measurement device may utilize either an inductive coil and/or an acoustic output device to provide the test drive signal to the implanted hearing instrument. In this embodiment, a magnetic field generated by the operation of the actuator may be read by the second measurement device in order to obtain the at least one test measure that is associated with an electrical signal passing through the actuator.

The operating logic of the combined system may be operative to selectively control the operation of the first and second measurement devices in any predetermined manner including upon user demand. In one embodiment, the operating logic may operate the first and second devices sequentially at first and second temporally separate times. In this embodiment, it may be preferable for one of the measurement device to receive an acoustic signal or test measure, as the case may be, then wait a predetermined period prior to the other measurement system receiving the other of the acoustic signal or test measure. In this regard, a patient's auditory component may return to a static position between measurements. Alternatively, the first and second measurement devices may be operated in an overlapping manner and/or simultaneously. In this regard, the first and second systems may operate over first and second predetermined frequency ranges. These frequency ranges may be non-overlapping and/or the system may further include filters such that responses associated with each of the first and second measurement device may be isolated within a received signal.

BRIEF DESCRIPTION OF THE DRAWINGS

FIGS. 13*a*-13*b* illustrate exemplary outputs that may be provided by the combined positioning system of FIG. 10.

DETAILED DESCRIPTION

Reference will now be made to the accompanying drawings, which at least assist in illustrating the various pertinent features of the present invention. In this regard, the following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to enable others skilled in the art to utilize the invention in such, or other embodiments, and with various modifications required by the particular application(s) or use (s) of the present invention.

Figure 1:
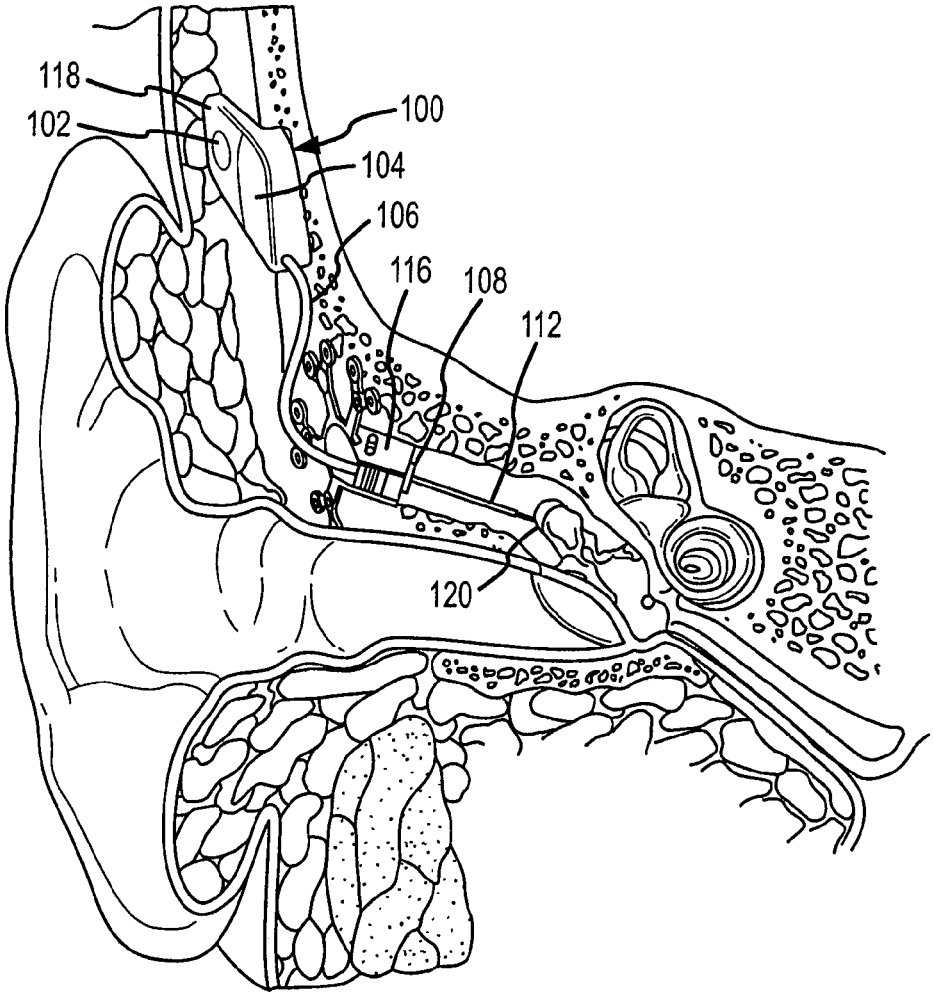
FIGS. 1, 2*a*, and 2*b* illustrate implantable and external componentry respectively, of a semi-implantable hearing aid device.
Figure 2A:
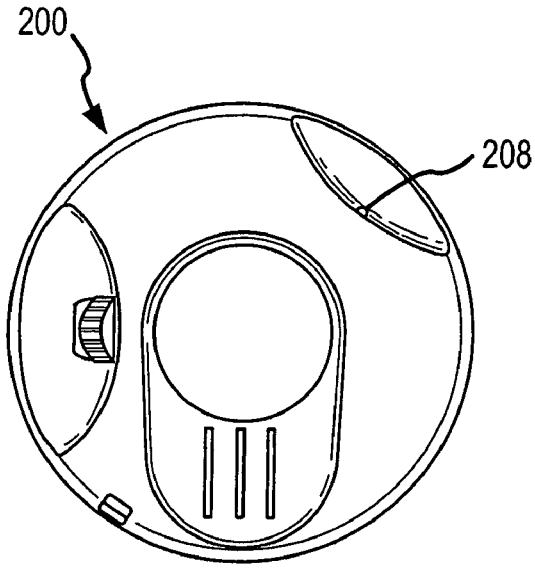
Figure 2B:
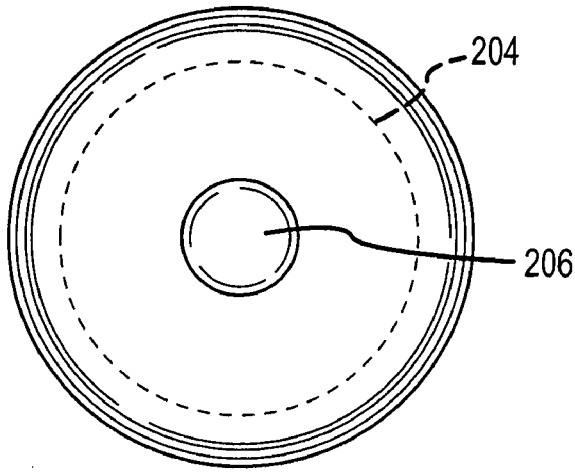

FIGS. 1, 2*a*, and 2*b* illustrate implantable and external componentry respectively, of a semi-implantable hearing aid device system. The illustrated system includes implanted components shown in FIG. 1, and external components shown in FIGS. 2*a* and 2*b*. As will be appreciated, the present invention may also be employed in conjunction with fully implantable systems, wherein all components of the hearing aid system are located subcutaneously.

In the illustrated example, an implanted biocompatible housing 100 is located subcutaneously on a patient's skull. The housing 100 includes a wireless audio signal link for receiving and/transmitting signals across the skin. Generally, such a wireless audio signal link will consist of an external modulator and transmitter for providing a signal(s) to a subcutaneous receiver and demodulator operatively interconnected to the implantable hearing instrument. In the present embodiment, the wireless audio signal link is an RF link and the housing includes an RF signal receiver/tranceiver 118 (e.g., comprising a coil element) and a signal processor 104 (e.g., comprising processing circuitry and/or a microprocessor). The signal processor 104 is electrically interconnected via wire 106 to a transducer 108. As will become apparent from the following description, various processing logic and/or circuitry may also be included in the housing 100.

The transducer 108 is supportably positioned in a mounting apparatus 116. The mounting apparatus 116 is attached to the patient's skull (e.g., via a hole drilled therein) typically within the mastoid process. The transducer 108 includes an actuator 112 designed to transmit axial vibrations to a member of the ossicular chain of the patient (e.g., the incus 120). The transducer 108 also includes a driver (not shown on FIG. 1) to drive the actuator 112 in response to transducer drive signals. The driver may be of any suitable design that causes the actuator 112 to stimulate an associated middle ear component, such as the incus bone 120, to produce or enhance the sensation of sound for the patient. For instance, some examples of the driver may include without limitation, an electrical, piezoelectric, electromechanical, and/or electromagnetic driver.

Referring to FIGS. 2*a* and 2*b*, the semi-implantable system further includes an external housing 200 comprising a microphone 208 and internally mounted audio signal processing (ASP) unit (not shown). The ASP unit is electrically interconnected to an RF signal transmitter 204 (e.g., comprising a coil element). The external housing 200 is configured for disposition proximate the patient's ear. The external transmitter 204 and implanted receiver 118 each include magnets, 206 and 102, respectively, to facilitate retentive juxtaposed positioning.

During normal operation, acoustic signals are received at the microphone 208 and processed by the ASP unit within external housing 200. As will be appreciated, the ASP unit may utilize digital processing to provide frequency shaping, amplification, compression, and other signal conditioning, including conditioning based on patient-specific fitting parameters. In turn, the ASP unit provides wireless audio signals (e.g., RF signals) to the transmitter 204. Such signals may comprise carrier and processed acoustic drive signal portions. The signals are transcutaneously transmitted by the external transmitter 204 to the implanted receiver 118. As noted, the external transmitter 204 and implanted receiver 118 may each comprise coils for inductively coupling signals therebetween.

Upon receipt of the wireless audio signals, the implanted signal processor 104 processes the signals (e.g., via envelope detection circuitry) to provide a processed drive signal via wire 106 to the transducer 108. According to this example, the drive signals induce axial vibrations of the actuator 112 at acoustic frequencies to cause a desired sound sensation via mechanical stimulation of the incus 120, which in turn drives the cochlea of the patient to produce and/or enhance the sensation of sound through the natural mechanical motions of the ossicular chain. As will also be appreciated, the vibrations are effectively communicated to the ossicular chain when an appropriate interface exists with the actuator 112. That is, if a desirable interface has been established, the actuator 112 will readily communicate axial vibrations to the incus 120. On the other hand, if the actuator 112 is "underloaded" (a loose or no interconnection has been established), axial vibrations may not be communicated. Furthermore, if the actuator 112 is "overloaded" against the incus 120, transmission may be adversely effected.

To illustrate the principles of the present invention, the following discussion uses the interface between the actuator 112, of the transducer 108, and the incus 120 as an example. It will be appreciated, however, that the present principles are equally applicable to other types of actuators that are designed to interface with the incus 120 or other components of the ossicular chain.

Figure 3:
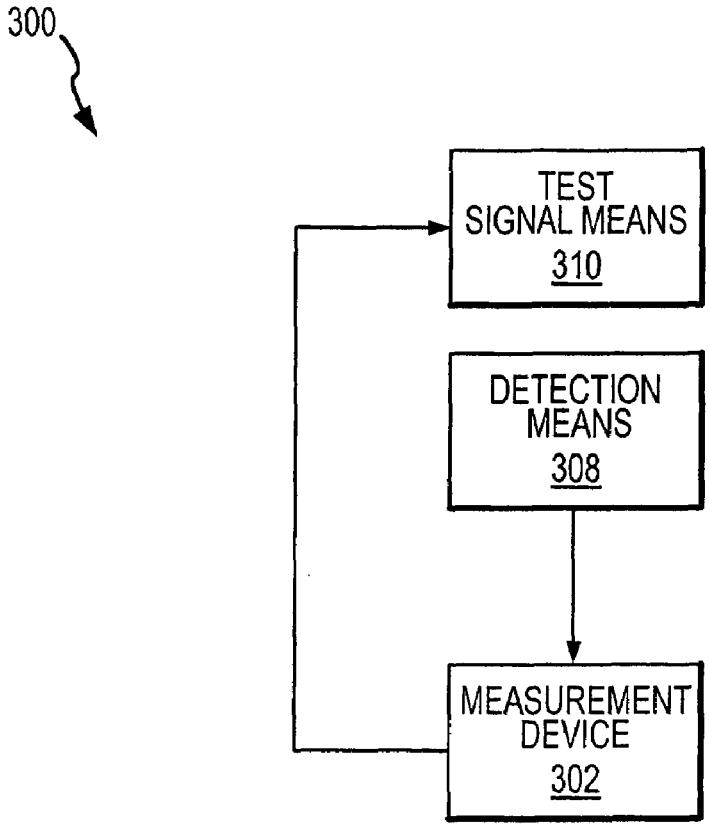
FIG. 3 illustrates an example of an acoustic transducer positioning system.

Device and Method for External Acoustic Assessment of an Implanted Hearing Aid Actuator:

Referring now to FIG. 3, to allow for external assessments of a position of the actuator 112 relative to the incus 120, an acoustic transducer positioning system 300 is provided. The acoustic system 300 includes a measurement device 302, a means 310 for providing a test signal to a patient, and a means 308 for measuring the resulting sound pressure from the ear canal of the patient (i.e., receiving an acoustic emission from the ear canal), that is generated in response to the test signal.

Operationally, the acoustic system 300 is designed to provide a test signal to a patient that causes a responsive acoustic signal from the ear canal of the patient. The acoustic system 300 is further designed to process the acoustic response, or at least one characteristic of the same, from the ear canal to assess a position of the actuator 112 relative to the incus 120. In particular, assessing the position of the actuator 112 relative to the incus 120 may include determining when, during an implantation procedure, the actuator 112 contacts the incus 120. The assessing may also include, subsequent to determining that contact has been made, determining a degree of contact or pressure applied on the incus 120 by the actuator 112. In this manner, the acoustic system 300 may be utilized to facilitate interfacing the actuator 112 with the incus 120 in a desired manner, e.g., an interface wherein optimal energy transfer between the actuator 112 and the incus 120 occurs. Thereafter, the acoustic system 300 may be utilized to asses the interface between the actuator 112 and the incus 120 at periodic time intervals subsequent to the initial implantation procedure, such as routine check-ups performed by an audiologist during the life of the implant. It will be appreciated that this is especially useful in monitoring the operational characteristics of the transducer 108 during subsequent visits to the audiologist.

The above noted processing of the acoustic response, or at least one characteristic of the same, from the ear canal may include a comparison the acoustic response, or one or more characteristics of the same, with one or more threshold/reference values and/or ranges. In particular, such comparisons may be made to identify changes in the acoustic response, or one or more characteristics of the same, caused by repositioning of the actuator 112 relative to the incus 120. More particularly, such comparisons may be made to identify changes in the acoustic response, or one or more characteristics of the same, caused by contact between the actuator 112 and the incus 120. In other words, a change in the acoustic response, or one or more characteristics of the same, is indicative of contact between the actuator 112 and the incus 120, while a rate of the change in one or more characteristics of the acoustic response may be utilized to determine a degree of contact.

In this regard, the acoustic response from the ear canal of the patient is related to the air gap(s) between the bones of the ossicular chain, which in turn is connected to the patient's tympanic membrane. Accordingly, as the actuator 112 contacts the incus 120, or is in contact with the incus 120, the air gap(s) is reduced, resulting in a reduced amount of movement or stiffening realized at the ossicular chain. Furthermore, the stiffening of the ossicular chain reduces the compliance of the interconnected tympanic membrane. These changes in the biological performance of the auditory system result in predeterminable changes in one or more characteristics of the acoustic response received from the ear canal of the patient in response to the test signal. The predeterminable changes in the one or more characteristics of the acoustic, response may in turn be utilized as indicators of the position of the actuator 112 relative to the incus 120, e.g., a non-contacting relation, a contacting relation, and/or a degree of contact, including when a desirable interface or contacting relation exists.

In this regard, the acoustic system 300 may be utilized to provide a plurality of test signals to the patient to stimulate the auditory component and cause the auditory component to generate a corresponding plurality of acoustic responses. Thereafter, the above noted processing of the acoustic responses, or one or more characteristics of the same, may include analysis of the plurality of acoustic responses, or one or more characteristics of the same, to assess the position of the actuator 112 relative to the incus 120. For instance, such analysis may include comparing a first and second response, the first and third response, the first and fourth response, etc., to identify a change in the acoustic responses resulting from a change in the relationship between the actuator 112 and the incus 120. For instance, if the acoustic responses are received during the positioning or advancement of the actuator 112 toward the incus 120, the change in the acoustic responses may be indicative of the point at which the actuator 112 contacts the incus 120. Thereafter, the change in the acoustic response may be indicative of the amount of contact therebetween.

Figure 4A:
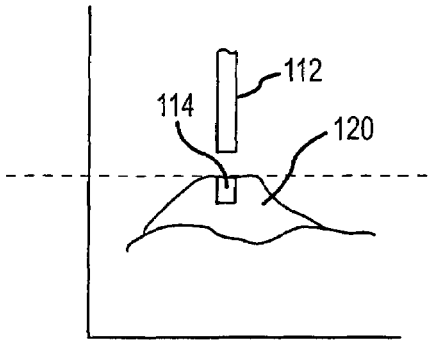
FIGS. 4*a*-4*d* illustrate positioning of an actuator relative to a an auditory component.

FIGS. 4*a*-4*d* illustrate the positioning of the actuator 112 relative to the incus 120 in order to generate one or more acoustic responses. As shown in FIG. 4*a*, the actuator 112 is in an initial position above the incus 120 and the incus 120 is positioned at a reference datum R-R'. That is, the actuator 112 is spaced from the incus in the initial position such that the incus 120 and actuator are in a non-contact relationship. Accordingly, the acoustic system 300 may be utilized to provide a test signal while the actuator 112 is in the initial position to obtain a non-contact reference measure, for example, a first acoustic response. This first acoustic response while the actuator 112 and incus 120 are disposed in the non-contact relationship may accordingly be utilized as a threshold value for comparison with subsequent acoustic responses.

Figure 4B:
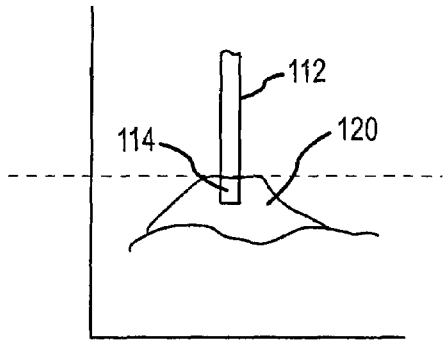
Figure 4C:
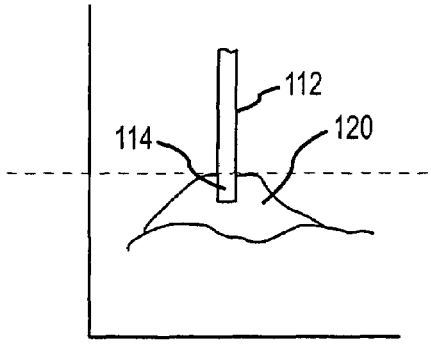
Figure 4D:
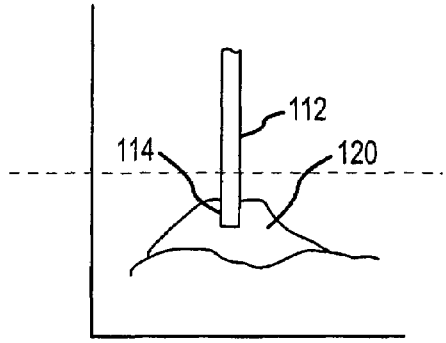

As shown in FIG. 4*b*, the actuator 112 is advanced (e.g., incrementally) towards the incus 120 in order to dispose the distal end of the actuator 112 into a laser ablation hole 114 within the incus 120. After advancement, the acoustic system 300 may again provide a test signal in order to obtain another acoustic response. As shown in FIG. 4*b*, actuator 112 contacts the incus 120. Accordingly, a test signal applied at this actuator position will result in a response, e.g., a second acoustic response, which will be different from the first acoustic response due to the contact between the actuator 112 and incus 120. Likewise, as shown in FIG. 4*c* the actuator 112 may be further advanced relative to the incus 120 until the distal end of the actuator 112 is seated in the bottom of the laser ablation hole 114. Again the acoustic system 300 may provide one or more test signals in order to generate a third acoustic response. As shown in FIGS. 4*a*-4*c*, the incus 120 is located at an initial position as donated by the reference line R-R'. As shown in FIG. 4*d*, the actuator 112 applies a loading to the incus 120 such that the incus is moved relative to the reference line R-R'. In this regard, FIG. 4*d* illustrates a situation wherein the actuator 112 overloads the ossicular chain thereby reducing the compliance of the connected auditory components of the patient. Irrespective, the acoustic system 300 may provide one or more test signals in order to generate, for example a fourth acoustic response associated with the overloaded condition. As will be appreciated, the acoustic system 300 may be utilized to provide a plurality of test signals in additional positions such that an optimal connection between the actuator 112 and the incus 120 may be determined, as will be further discussed herein.

In another example, a comparison of acoustic responses, or at least one characteristic of the same, may include comparing acoustic responses, such as a first and second response, a second and third response, a third and fourth response, etc. to identify a rate of change in the acoustic responses. Again, the rate of change may be utilized to identify a change in the relationship between the incus 120 and the actuator 112, e.g., such as contact and degree of contact.

In another example, a combination of comparisons may be utilized. For instance a comparison of the first and second acoustic response, the first and third acoustic response, etc. may be utilized to determine when contact is made, while a comparison of the first and second, the second and third, etc. may be utilized to determine the degree of contact as a function of the rate of change in the acoustic responses after contact is made.

As will be discussed herein, the measurement device 302 may include various processing logic to facilitate positioning of the actuator 112 relative to the incus 120. For instance, the measurement device 302 may utilize instructions that are stored on storage media. The instructions can be retrieved and executed by a processing system. Some examples of instructions are software, program code, and firmware. Some examples of storage media are memory devices, tape, disks, integrated circuits, and servers. The instructions are operational when executed by the processing system to direct the processing system to operate in accord with the invention. The term "processing system" refers to a single processing device or a group of inter-operational processing devices. Some examples of processing systems are integrated circuits and logic circuitry. Additionally, the threshold values and/or ranges utilized by the measurement device 302 may be predetermined stored values. Alternatively, the measurement device 302 may be utilized to determine patient specific threshold values and/or ranges, e.g., during the initial implant procedure.

The means 310 for providing the test signal may be any device or group of devices configured to stimulate a patient's auditory system to cause an acoustic response emission from the ear canal of the patient. In particular, it is desirable that the means 310 provide the stimulation to the auditory system externally to minimize the invasiveness of the procedure. For instance, the means 310 may be a bone vibrator configured to vibrate one or more bones of the skull to cause a movement of the ossicular chain and acoustic response emission from the ear canal. In another instance, the means 310 may be a device such as a microphone configured to provide an acoustic signal to the ear canal of the patient to cause movement of the ossicular chain and an acoustic response emission from the ear canal. Those skilled in the art will appreciate various other methods for stimulating the auditory system to generate an acoustic response in the ear canal of a patient.

The means 308 for receiving the acoustic response from the ear canal may be any device or group of devices configured to detect an emission from an ear canal and provide the same to the measurement device 302. For instance, the means 308 for receiving may be a microphone or other similar acoustic signal receiver/sound detection device designed to detect acoustic signals.

Figure 5:
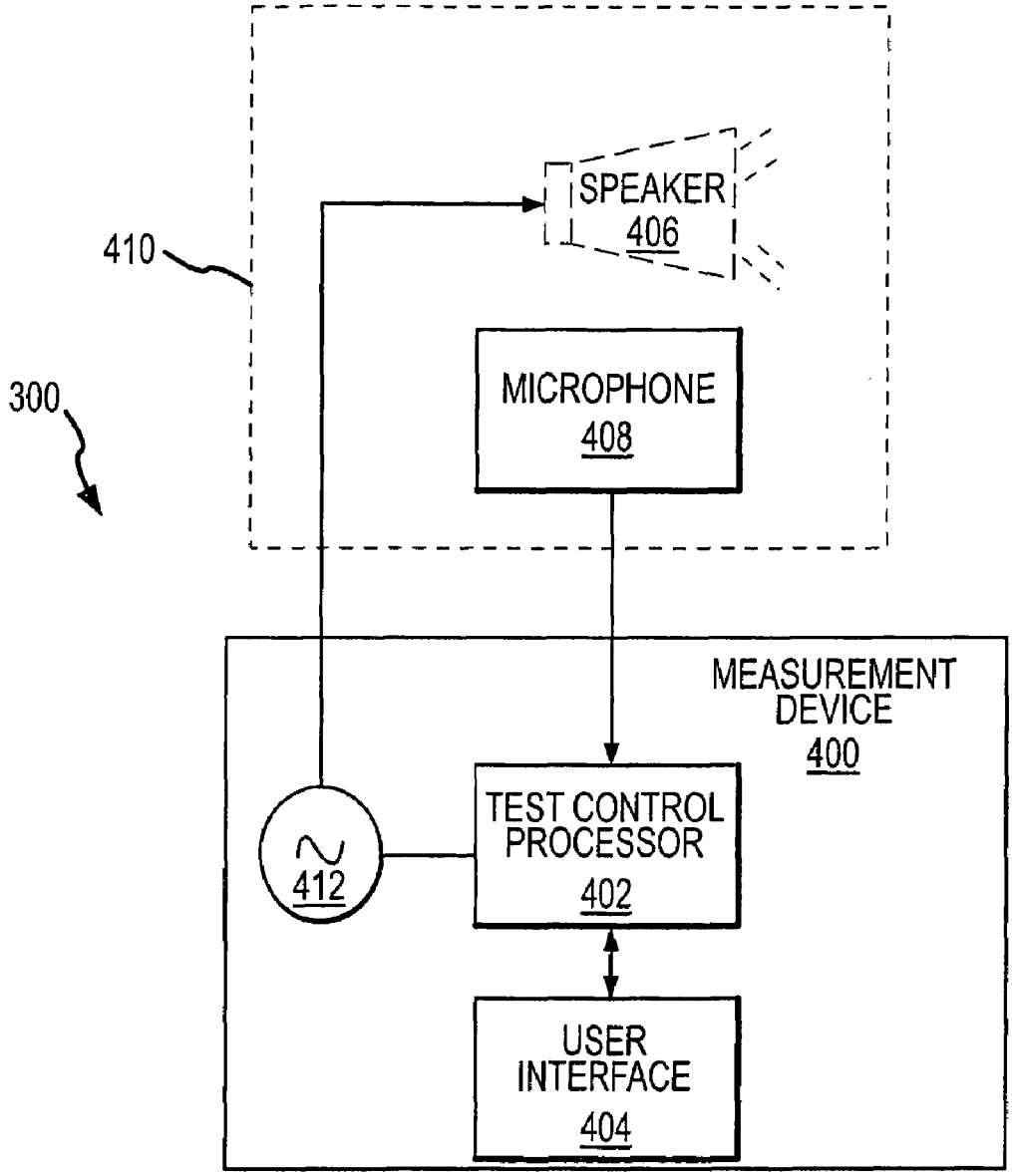
FIG. 5 illustrates another example of an acoustic transducer positioning system.

Referring to FIG. 5, according to one example of the present invention, the acoustic system 300 may include a measurement device 400, a microphone 408, and a speaker 406. According to this characterization, the measurement device 400 may include a test control processor 402, a user interface 404, and a signal generator 412. The user interface 404 in turn, may include one or more conventional means (not shown) for displaying output and control information to a user of the acoustic system 300, such as a display screen(s). The user interface 404 may also include one or more conventional means for receiving input from the user such a keyboard and/or a mouse or other similar device. The user interface 404 is in turn configured to exchange information with the user and the test control processor 402.

The test control processor 402 may be one or more processors having processing logic for setting the signal generator 412 to output a test signal(s) at a predetermined frequency or frequencies according to inputs received from the user at the user interface 404. The test control processor 402 may further be configured to store signal characteristics of the test signal (s) for later use in processing the acoustic response emitted from the ear canal of the patient. The test control processor 402 may be further operational to receive an acoustic response from the ear canal of the patient, via the microphone 408, that is generated in response to the test signal(s). Upon receiving the acoustic response, the test control processor 402 may be operational to process the acoustic response to assess a position of the actuator 112 and/or an interface between the actuator 112 and the incus 120.

The processing may include comparing one or more characteristics of the acoustic response with a threshold/reference level or threshold/reference range. For instance, the test control processor 402 may utilize acoustic characteristics including without limitation, magnitude, or level of the acoustic response, frequency of the acoustic response, phase of the acoustic response, etc. In addition, the test control processor 402 may utilize one or more combinations of acoustic characteristics including without limitation a combination of the magnitude or level of the acoustic response, frequency of the acoustic response, and/or phase of the acoustic response, etc. The threshold level or threshold range may be a predetermined value(s) programmed into and maintained by the test control processor 402 or it may be a reference value(s) that is determined by the test control processor 402 through one or more test events. In the present context a test event may be defined as the provision of one or more test signals to the patient and the receipt of a corresponding one or more acoustic responses from the ear canal of the patient.

In the former case, the threshold values may be preprogrammed values in the test control processor 402 that are utilized as a reference or baseline to detect changes in the one or more characteristics of the acoustic response from the ear canal. The changes in the one or more characteristics of the acoustic response in turn, being indicative of contact between the actuator 112 and incus 120, as well as the degree or level of such contact. In the latter case, the acoustic system 300 may be utilized to acquire threshold/reference acoustic characteristics for a given patient. According to this example, the test control processor 402 may be configured to process an acoustic response from the ear canal of the patient that is generated in response to a given test signal provided to the patient prior to implantation of the transducer 108. In particular, the test control processor 402 may utilize the acoustic characteristics of the acoustic response to generate information relating to the present state of the patient's ossicular chain, e.g., mobility and/or stiffness information, prior to interfacing the actuator 112 therewith. Thereafter, the acoustic characteristics, the mobility, and/or stiffness information, may be utilized as threshold values and or ranges during implantation to determine when the actuator 112 contacts the incus 120, and thereafter the degree or level of contact, e.g., pressure on the incus 120.

The signal generator 412 may be any device or group of devices configured to generate test signal(s) for the speaker 406 under the control of the test control processor 402. According to the present example, the test signals are provided to the speaker 406, which outputs the test signals as an acoustic sound to the ear canal of the patient. It will be appreciated that various different forms of test signals may be utilized according to the present invention. For instance, the test signal may include without limitation, a sine wave component, digitally generated pseudorandom noise, white noise, audible tone, such as a chirp, at one or more frequencies, etc. The test control processor 402 may also cause the signal generator 412 to sweep the test signal across a predetermined frequency range, as discussed further below.

The speaker 406 and microphone 408 may be provided in a common housing 410, as illustrated by the dashed outline on FIG. 4, or alternatively in separate individual housings. In the former case, it may be desirable that the housing 410 be ergonomically shaped and configured to fit over the patient's ear in a sealed manner. For instance, the speaker 406 and microphone 408 may be in a housing having a gel or foam ear seal to isolate the provision of the test signal and receipt of the acoustic response emission from the ear canal, e.g., prevent outside noise from interfering with the same. Alternatively, the housing 410 may be ergonomically configured for insertion at least partially into the ear canal of the patient to direct the test signal into the middle ear and facilitate receiving the responsive emission from the ear canal. Furthermore, the electrical connections between the test measurement device 400, the speaker 406, and microphone 408, may be made by a wireline, e.g., a cable, or a wireless connection, such as Infrared (IR). In any case, it will be appreciated that the acoustic measurement system 300 would include other conventional hardware, such as infrared ports or cable connection jacks not shown on FIG. 5 for clarity.

Figure 6:
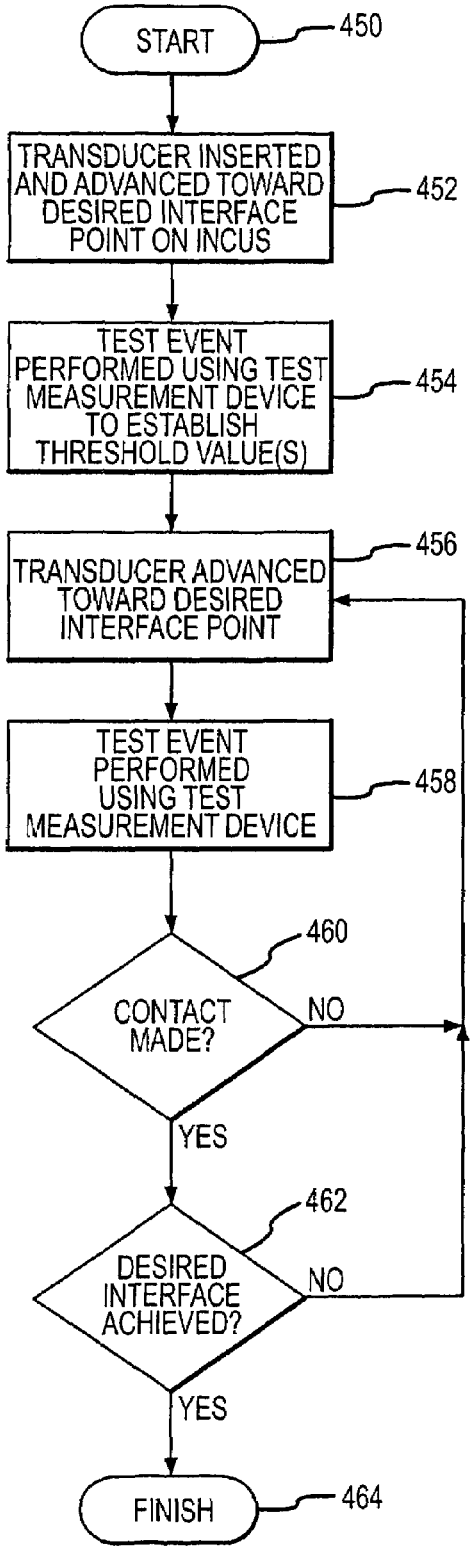
FIG. 6 illustrates example of an operational protocol of the test measurement system of FIG. 5.

FIG. 6 is a flow chart illustrating an example of an operational protocol of the acoustic measurement system 300. According to this example, the acoustic system 300 is utilized during an initial implantation procedure for the transducer 108. On FIG. 6, operation begins at step 450, with the preparation of the patient and forming of an opening in the mastoid process, as conventionally performed in the art. At step 452, the transducer 108 may be inserted into the opening and advanced toward a desired interface point on the incus 120. It should be noted, however, that at step 452, the transducer 108 is initially positioned adjacent to, but in a non-contacting relation to the incus 120. In this initial position, at step 454, a first test event may be performed to establish patient specific threshold values(s)/reference measure(s) for the patient. Thus, at step 454, the housing 410 is positioned relative to the ear canal of the patient and a test signal of known characteristics is provided to the ear canal via cooperation of the test control processor 402, signal generator 412, and speaker 406. As noted above, the test signal may be an acoustic tone, e.g., pure tone or chirp, provided to the ear canal of the patient at one or more frequencies. Alternatively, the test signal may be swept across a plurality of different frequencies distributed across a predetermined frequency range. In the case of sweeping of the test signal, it is desirable that the test signal frequencies be selected from a range of frequencies chosen so as to be narrow enough to sweep the test signal in a timely manner, but broad enough to provide useful information relating to the acoustic response received from the ear canal. In this regard, the frequency range from substantially 1 kHz to 5 kHz will provide information relating to the biological aspects of the ossicular chain, e.g., mobility and/or stiffness, resonance associated with the ossicular chain and resonance associated with the ear canal, while permitting performance of the test invent in a reasonable time.

In response to provision of the one or more test signals, the microphone 408 receives one or more acoustic response emissions from the ear canal. The acoustic response emissions are provided to, and processed by, the test control processor 402 to establish the reference acoustic characteristics of the acoustic response emission, absent contact by the actuator 112. Upon establishing the reference value(s), at step 454, the transducer 108 may be further advanced toward the desired interface point on the incus 120, at step 456. During the advancing step 456, e.g., substantially simultaneous thereto, the test measurement device 400 is utilized to conduct a series of test events at step 458, as the transducer 108, and in particular the actuator 112, is advanced toward the interface point on the incus 120. In this regard, the measurement device 400 utilized to determine when the actuator 112 contacts the incus 120 and thereafter the degree of such contact. Thus, if at step 460, contact with the incus 120 is made, the test control processor 402 determines at step 462 if a desired interface exists between the actuator 112 and the incus 120. If at step 462, a desired interface exists between the transducer 108 and the incus 120, the position of the transducer 108 is fixed, as conventionally done in the art, and the method ends at step 464. If a desired interface does not exist, the actuator 112 is repositioned and steps 458 through 462 are repeated.

In this regard, in one example of the processing logic utilized by the test control processor 402 at step 460, the one or more acoustic characteristics of the acoustic response from the ear canal may be a phase. In another example, the one or more acoustic characteristics of the acoustic response from the ear canal may be a magnitude of the acoustic response emission or a magnitude of the phase. In another example, the one or more acoustic characteristics of the acoustic response from the ear canal may be a combination of a magnitude and a phase. In any case, the test control processor 402 may calculate the phase and magnitude of the transfer function between the test signal provided to the speaker 406 and the acoustic response received by the microphone 408. Thereafter, the test control processor 402 may utilize changes in the magnitude and/or the phase of the transfer function to determine changes in the stiffness of the ossicular chain. In one example according to this characterization, the test control processor 402 may utilize the acoustic impedance of the ossicular chain to determine changes in the stiffness of the ossicular chain, as the impedance is directly related to the stiffness and determinable using acoustic response received for a known test signal input. The changes in the stiffness are in turn directly related too, and indicative of, contact by the actuator 112, and the degree of such contact or pressure applied on the ossicular chain. In this regard, to improve the signal-to-noise ratio, the test control processor 402 may utilize an average of the time-domain acoustic response received at the microphone 408 from the ear canal in response to the test signal. Furthermore, the processing techniques described above may entail iterative comparison of the measured ossicular stiffness with the one or more threshold values to achieve a desired positioning and interface between the transducer 108 and incus 120 as noted by the arrows on FIG. 6.

The test control processor 402 may also utilize display logic to control an output on the user interface 404 to facilitate the above operation. In one example, the output may be in the form of an audio indicator that provides a series of tones that indicate when a desired contact or interface is established. In another example, the output may be a graphical or other representation on the user interface that indicates when the actuator 112 is properly interfaced with the incus 120, as will be further discussed herein. In another example, the output may further indicate whether the actuator 112 is underloaded or overloaded relative to the incus 120, to provide an audiologist or surgeon with information regarding the requisite repositioning of the actuator 112. It will be appreciated that other methods of indication could be utilized as a matter of choice.

As noted above, the acoustic system 300 may also be utilized to assess the status of the interface between the actuator 112 and the incus 120 subsequent to the initial implantation procedure using the above operation. Advantageously, such assessment is performed in a substantially non-evasive manner, as no surgical procedure is necessary. Also advantageously, patient specific thresholds determined at the time of the initial implant may be stored and utilized during subsequent assessments of the interface between the actuator 112 and incus 120.

Figure 7A:
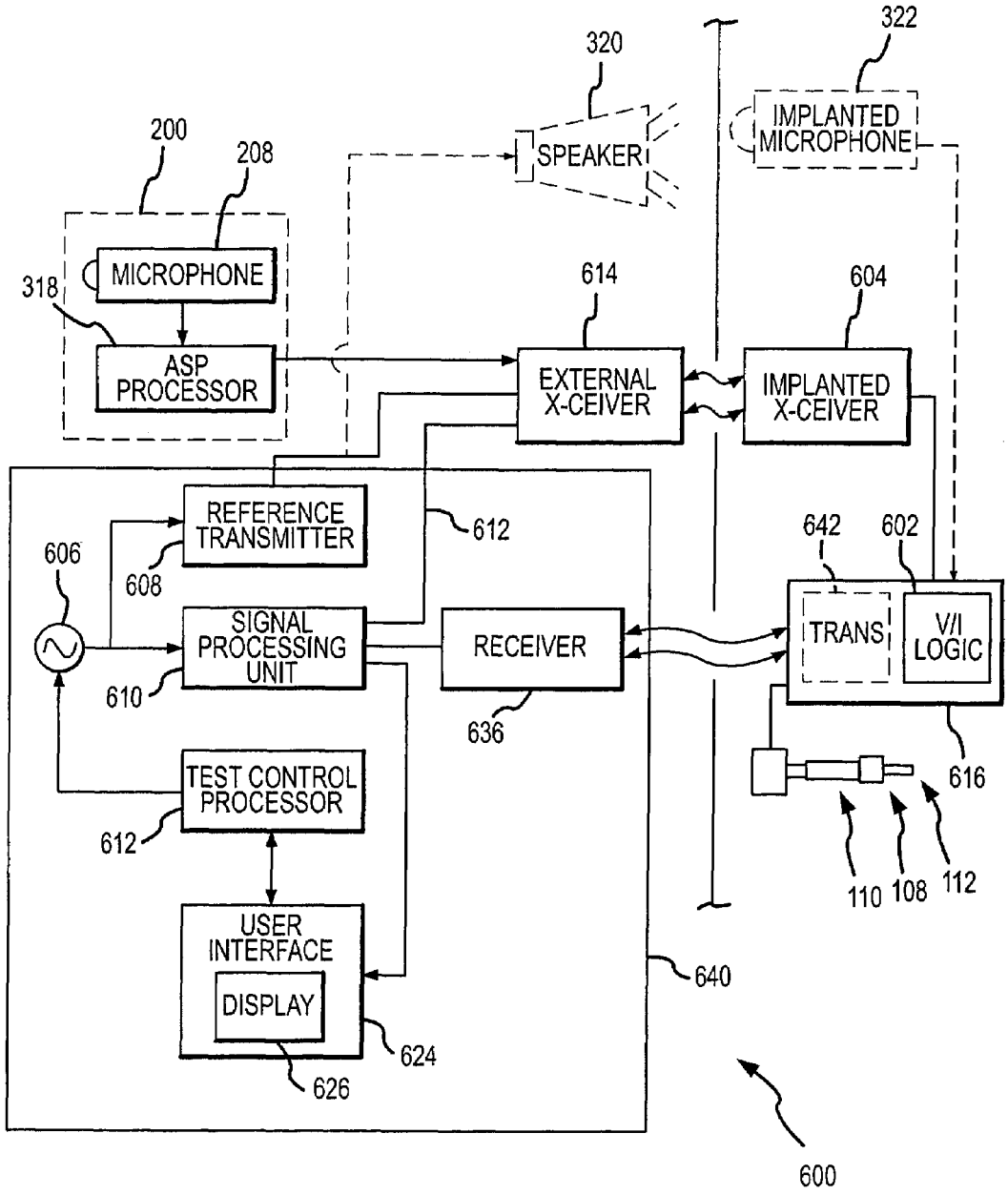
FIGS. 7*a*-7*b* illustrates alternate examples of electrical transducer positioning systems.

Device and Method for External Electrical Assessment of an Implanted Hearing Aid Actuator:

Referring now to FIG. 7*a*, one embodiment of the present invention provides a transducer positioning system 600 that provides an indication of transducer position based on a test measure associated with an electrical signal passing through the implanted transducer 108 (i.e., an electrical measurement system). The system 600 uses an externally positioned test measurement device 640 to obtain measurements of the voltage and current, and thus the electrical impedance (electrical impedance=voltage/current), of an electrical signal passing through the transducer 108. Such electrical impedance is directly related to the mechanical impedance present at the interface between the implanted transducer and middle ear of a patient. As such, the resultant electrical impedance measures may be utilized to assess whether the transducer 108 is operative and whether a desired interface between the transducer 108 and the middle ear of patient (e.g., the ossicular chain) is present. The impedance measurements are made in response to the input of the above-described test signals. The test measurement device 640, in turn, uses predeterminable thresholds and ranges for test measure comparisons and generation of data indicative of the test results for an audiologist or other user.

On FIG. 7*a*, alternate applications for utilizing measurement device 640 are illustrated. Again, such applications correspond with the use of the device 640 for assessing performance of semi-implantable and fully implantable hearing aid systems. The illustrated embodiment includes an oscillator 606, a reference transceiver 614, a signal processing unit 610, a test control processor 612, a user interface 624, and a receiver 636. The test control processor 612, oscillator 606, and reference transmitter 608 cooperate to provide one or more test signals for assessing the performance of the implanted hearing aid system componentry, including the implanted electromechanical transducer 108. More particularly, the test control processor 612 may provide the signals for setting oscillator 606 to output a reference signal at a predetermined frequency to the reference transmitter 608 and signal processing unit 610. The test control processor 612 may also provide signals for setting oscillator 606 to output a reference signal that may be swept across a predetermined frequency range. In turn, the reference transmitter 608 outputs a wireless test signal (e.g., an RF signal).

In the case of a semi-implantable hearing aid system, the measurement device may utilize an external transceiver 614 and an implanted transceiver 604. The external transceiver 614 is included to inductively couple the reference signals to the implanted transceiver 604. The external transceiver 614 also receives the voltage and current measurements from implanted transceiver 604 and provides the voltage and current measurements to the signal processor 610 via the path 612. The implanted transceiver 604 on the other hand receives the reference signals for the implanted signal processor 616 and provides the voltage and current measurements to the external transceiver 614. The voltage and current measurements are provided to the implanted transceiver 604 by voltage and current (V/I) measurement logic 602 as will be discussed below. The implanted signal processor 616 extracts and conditions the reference signal and supplies the reference signal to the implanted electromechanical transducer 108.

In a fully implantable system embodiment, the test signal output by reference transmitter 608 may be provided to the speaker 320 for outputting an acoustic test signal. In turn, the microphone 322, utilized in the fully implantable system, subcutaneously receives the acoustic test signal and provides the test signal to the signal processor 616. As with the above embodiment, the implanted signal processor 616 may comprise signal processing capabilities analogous to those of ASP processor 318. In any case, the implanted signal processor 616 provides test signals to drive the implanted electromechanical transducer 108.

The signal processor 616 also includes voltage and current (V/I) measuring logic 602. The V/I measuring logic 602 measures the voltage and current of the test signals provided to the transducer 108. Further, in the case of a fully implantable hearing aid embodiment, the signal processor 616 also includes a transmitter 642 to provide the voltage and current measurements to the receiver 636 in the test measurement device 640. In other words, in the semi-implantable embodiment, the V/I measuring logic 602 provides the voltage and current measurements to the transceiver 604, while in the fully implantable embodiment, the V/I measuring logic 602 provides the voltage and current measurements to the transmitter 642. The transceiver 604 in turn provides the voltage and current measurements to the signal processor 610 via the transceiver 614 while the transmitter 642 provides the voltage and current measurements to the signal processing system 610 via the receiver 636.

The transmitter 642 and receiver 636 could be any device capable of transcutaneously exchanging signals indicative of the measured voltage and current. In one example, the transmitter 642 and receiver 636 could be an infrared transmitter and receiver. In another example, the transmitter 642 and receiver 636 could be a pair of coils that inductively couple signals therebetween. It will be appreciated, however, the receiver 636 may be included in a separate housing and may provide the inductively coupled information to the processing unit 610 via a wireless or wireline connection.

Figure 7B:
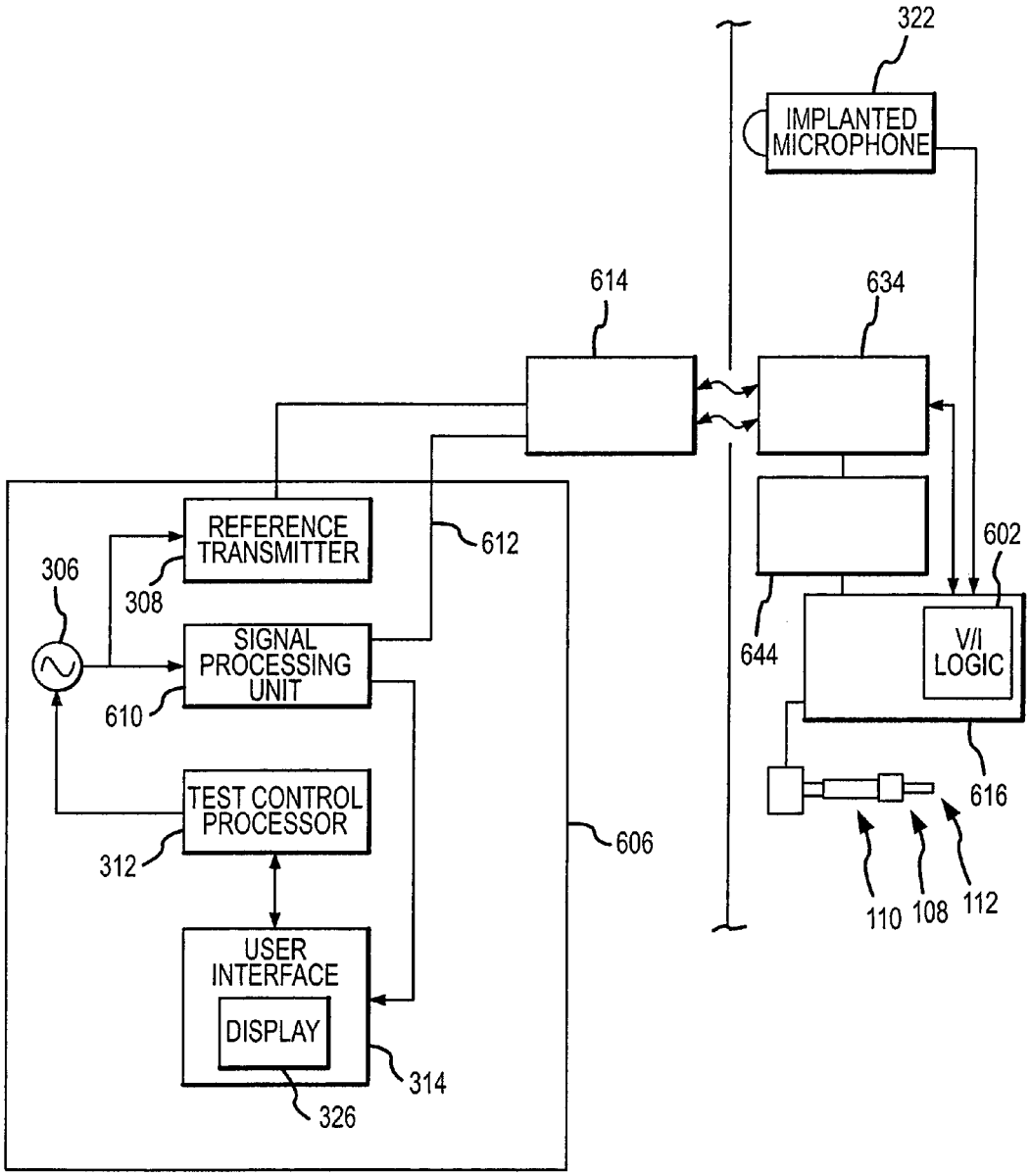

FIG. 7*b* illustrates a second embodiment of the test measurement device 640 that may be utilized in fully implantable systems. In this embodiment, the internal componentry of the test measurement device 640 is substantially identical to those discussed in relation to FIG. 7*a*. However, the test measurement device 608 utilizes an inductive coupling between external coil 644 and an implanted coil 634. The external coil 644 is utilized to inductively couple a test drive signal from the reference transmitter 608 to the internal coil 634. Likewise, the external coil 644 is utilized to receive voltage and current measurements from the implanted coil 634 and provide those voltage and current measurements to the signal processor 610 via path 612.

The internal coil 634 provides the received test drive signal (s) to the internal signal processor 616 which generates drive output signal that is transmitted to the actuator 112 and hence the patient's auditory component. Voltage and current measurements associated with the output signal of the implanted signal processor are then provided to the internal coil 634 by voltage and current measuring logic 602. Changes in the inductive field generated by the internal coil 634 are in turn read by the external coil 624. These reading provide voltage and current information to the measurement device 640.

As shown, the internal coil 634 is operatively interconnected to an internal power storage device 646 (e.g., battery) that is utilized to power the implanted hearing aid device. In this regard, the signal measurement device 640 of FIG. 7*b* is operative to provide indications of transducer positioning without requiring specialized componentry. That is, in the embodiment shown, the internal coil 634 may be primarily utilized for charging the internal power storage device 644. However, it will be further appreciated that separate dedicated implanted coils may be utilized with the current system.

In either of the systems illustrated in FIGS. 7*a* and 7*b* the voltage and current measurements from the V/I logic 602 are processed by the signal processing unit 610. The processing could be any processing representative of generating an output indicative, or that may be used, to assess the performance of the implanted componentry of semi-implantable or fully-implantable hearing aids. In one example, the signal processing unit 610 may compute the impedance of the transducer 108 and compare the computed impedance to the frequency of the original test signal provided to the signal processing unit 610 by the oscillator 606. The output of the signal processing unit 610 is provided to the user interface 624 and more particularly to the display 626, as further described in reference to FIG. 8.

Figure 8:
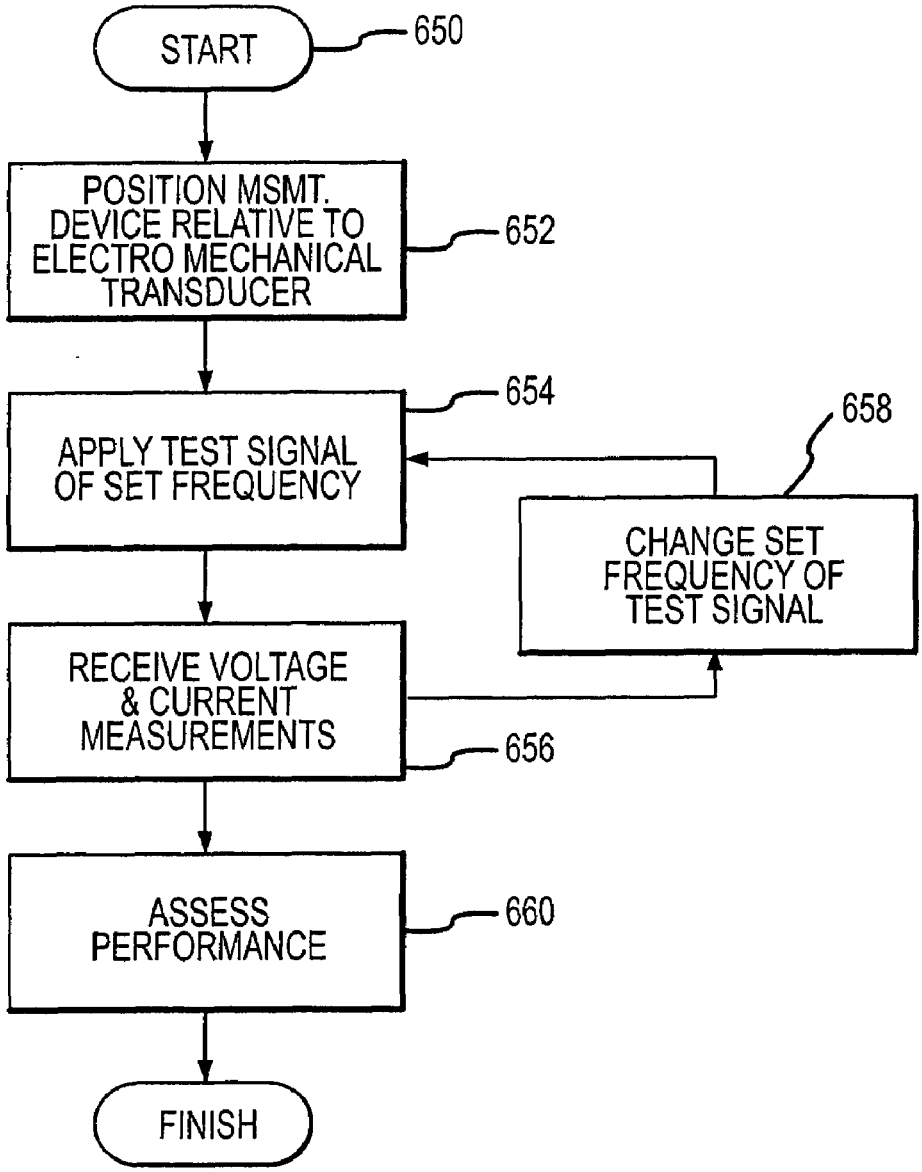
FIG. 8 illustrates example of an operational protocol of the test measurement system of FIGS. 7*a*-7*b;*

FIG. 8 illustrates a process (650) corresponding with an exemplary performance testing using the above-described embodiment of the present invention. On FIG. 8, the measurement device 640 is positioned (652) proximate to the patient so that the receiver 636 may receive the V/I measurements from the V/I logic 602. A test signal of known characteristics is then provided (654), e.g., via cooperation of the test control processor 612, oscillator 606, and reference transmitter 608. In turn, the measurement device 640 is utilized to receive (656) voltage and current measurements from the V/I logic 602 in response to the applied test signal.

Further in this regard, the voltage and current measurement (s) may be utilized in a preliminary assessment (660) of the performance of the implanted componentry of the given semi or fully-implantable hearing aid system. For instance, if a voltage and current is not measured, signal processing unit 610 may determine that one or more connections or one or more implanted components of a given implanted hearing aid system is faulty. In turn, an appropriate output indicating the same may be provided at user interface 614. In the event that the preliminary assessment (660) indicates that the implanted componentry and interconnections appear operational, the process (650) may continue to further assess the performance of the transducer interface with the middle ear of a patient.

Specifically, and referring to FIG. 8, the test control processor 612, oscillator 606, and reference transmitter 608, may cooperate to provide (654) a test signal of predetermined frequency to drive the transducer 108. In turn, the voltage and current of the generated drive signal for transducer 108 may be measured by the V/I measurement logic 602 and the measurements used to determine whether the desired transducer/middle ear interface is present. By way of example, where the resonant frequency fr of the given implanted transducer 108 is known, the test signal may be provided (654) at such frequency or within a predetermined range thereof (f1 to f2), and the resultant impedance measurement (computed from the voltage and current measurements) compared to the known frequency of the test signal.

Figure 9:
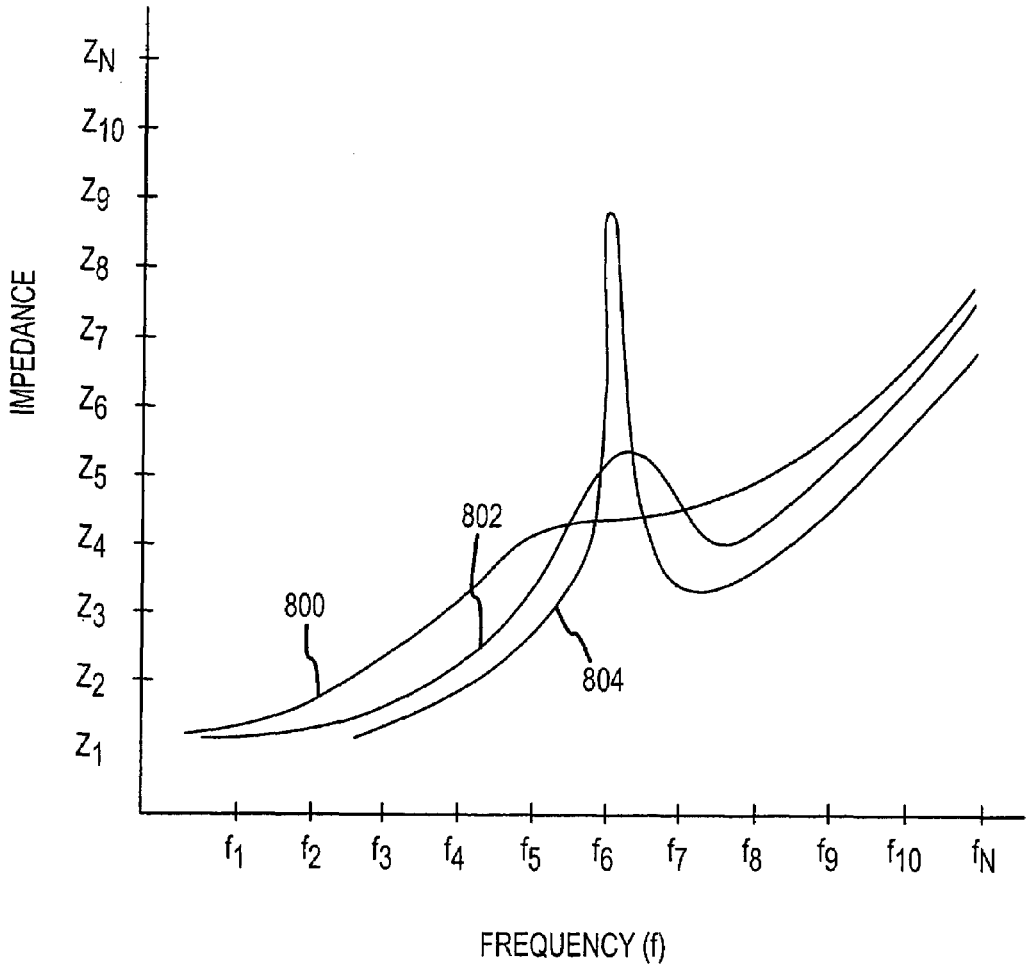
FIG. 9 illustrates an example of an output that may be provided by the electrical transducer positioning system of FIGS. 7*a*-b.

In this regard, it will be appreciated that a graphical comparison of the impedance versus the frequency is predeterminable for an operable transducer 108 driven at its resonant frequency fr when the transducer 108 is "underloaded" (no physical interface with an ossicular chain is present), as indicated by the plot 804 of FIG. 9. Further, when a physical interface is present, a graphical comparison of the impedance versus the frequency for an operable transducer 108 driven at its resonant frequency fr is also predeterminable as indicated by the plots 800 and 802. Still further, when a physical interface is present, and is also a desired interface, a graphical comparison of the impedance versus the frequency is predeterminable as indicated by the plot 802. Still further yet, when an "overloaded" physical interface is present, a graphical comparison of the impedance versus the frequency is predeterminable for an operable transducer 108 driven at its resonant frequency fr, as indicated by the plot 800. Thus, predeterminable comparisons of the impedance versus the known test signal frequency may be employed to assess whether an interface is present and if so whether the interface is a desirable interface (e.g., not "underloaded" or "overloaded").

In a further approach, a plurality of voltage and current measurements may be made in corresponding relation to the setting (658) of the test signal at a corresponding plurality of different frequencies. Such sweeping of the test signal frequency yields a plurality of impedance measurements from which a minimum value may be identified. Such minimum value will correspond with the resonant frequency of the given implanted electromechanical transducer 108. In turn, performance assessment may be completed utilizing ranges analogous to those indicated above.

In this regard, those skilled in the art will recognize various pluralities of different frequencies that could be used, and therefore the following examples are provided for the purpose of illustration and not limitation. Preferably, the range of frequencies chosen are narrow enough so that sweeping of the test signal frequency can be performed in a timely manner, but broad enough to provide useful information relating to the performance of the implanted transducer 108. For example, using the frequency range from substantially 1 kHz to 5 kHz will provide information relating to the biological aspects of the interface, e.g., resonance associated with the ossicular chain and resonance associated with the ear canal resonance. On the other hand, while taking longer to perform the sweeping function, using the frequency range from substantially 100 Hz to 10 kHz will provide information on the biological aspects as well as the electrical aspects of the transducer 108, e.g., resonance of transducer 108, etc.

Device and Method for Combined External Electrical and Acoustic Assessment of an Implanted Hearing Aid Actuator:

As discussed above in relation to FIGS. 1-9, various methods and corresponding systems are presented for determining whether desired interface is present between the actuator 112 of an implanted transducer 108 and the middle ear of a patient (e.g., the ossicular chain). Specifically, the first methodology and corresponding system 300 measure acoustic signals from the patient's ear canal for use in determining the suitability of the interface. The second methodology and corresponding system 600 obtain measurements associated with electrical signals passing through the implanted hearing instrument. Each system 300 and 600 is effective to provide an indication of the coupling between the actuator and the middle ear component of a patient.

However, for various reasons, including individual physiological parameters, it has been determined that in some instances acoustic assessment is preferable and in other instances external electrical assessment is preferable. Further, in many cases the utilization of both an acoustic system 300 and an electrical system 600 may provide additional feedback that may allow for improved transducer positioning. Accordingly, a combined system is provided that allows for selective and/or combined use of an acoustic measurement positioning and electrical measurement positioning.

Figure 10:
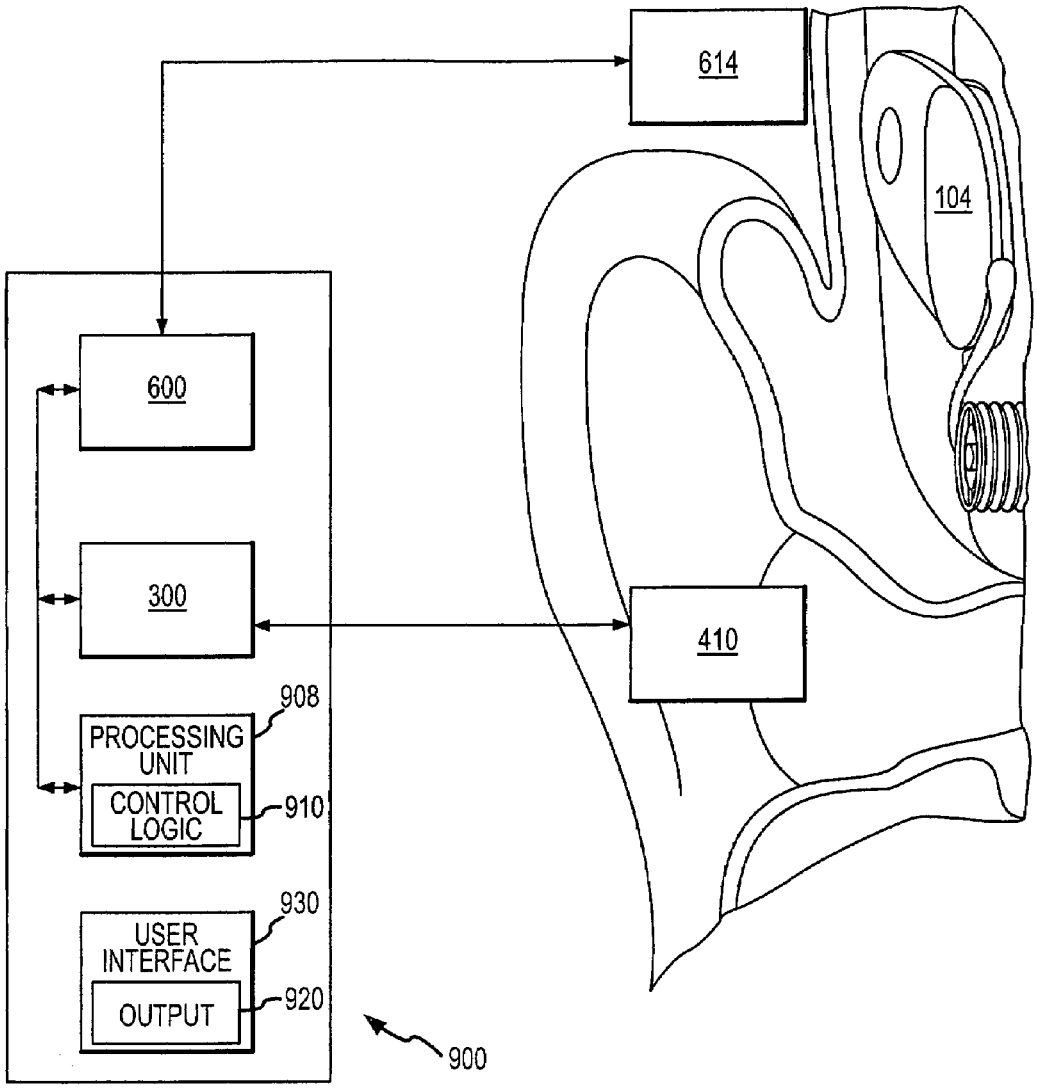
FIG. 10 illustrates an example of a combined acoustic and electrical transducer positioning system.

FIG. 10 shows one embodiment of a combined positioning system 900 that provides both acoustic and electrical assessment of the interface between the actuator 112 and the patient's ossicular chain. As shown, system 900 includes an external electrical assessment system 600 and an external acoustical assessment system 300. Furthermore, the combined system 900 includes a processor 908 and control logic 910 for coordinating the operation of the two assessment systems 300, 600. Of note, the acoustic and electrical system, respectively, may be stand alone systems incorporated into a common system 900, or the separate systems 300, 600 may share common componentry. For instance, the two systems 300, 600 may share processing capabilities test signal generation capabilities, etc. What is important is that the two separate systems 300, 600 are operative to provide separate indications of the position of the transducer 108 relative to the middle ear component of a patient.

The combined system 900 also includes an output device 920. In one example, the output device 920 may provide audio indicators such as a series of tones for each the acoustic system 300 and the electrical system 600. These tones may indicate when a desired contact interface is established. In another example, the output may be graphical or other representation that provides an indication of the interface between the actuator 112 and the incus 120. Furthermore, the graphical output may indicate a range values for each the acoustic system 300 and the electrical system 600 that may further indicate whether the actuator is in an underloaded or overloaded position relative to the incus 120 in order to provide an audiologist or surgeon with information regarding the need/desirability of further positioning of the actuator 112.

The combined system 900 also includes a user interface 930 that allows a user to control the operation of the system 900. The user interface may incorporate various user inputs for control of the systems 300, 600. For instance, device 900 may incorporate keypad or other entry devices that allows surgeon or audiologist to control the functioning of the various systems 300, 600. Alternatively, system 900 may incorporate a hands free user control device would allow a surgeon or audiologist to control the system 300, 600. In one embodiment, one or more foot pedals may be operatively interconnected to the combined system 900 such that a user may initiate operation of one or both systems 300, 600 without requiring the surgeon to reposition himself relative to the patient.

In operation, the control logic 910 may be operative to control the acoustic system 300 and electrical system 600 in any appropriate manner. In one embodiment, the control logic 910 may be operative to generate test signals for a first system (e.g., electrical system 600) receive responsive outputs for that system and once such outputs are obtained, obtain a second output from the other system (e.g., acoustic system 300). In this regard, each system may be utilized at temporally separate times to stimulate the patient's auditory system in order to generate first and second outputs that are indicative of the position of the actuator 112 relative to the middle ear component. Such a system is analogous to a time division multiplexing scheme.

In a further embodiment, the control logic 910 may be operative to obtain outputs from the electrical system 600 and acoustic system 300 in an overlapping and/or simultaneous manner. For instance, the control logic may be operative to operate the electrical system 600 at a first frequency while the acoustic system 300 is operated at a second frequency. As both systems 300, 600 may operate at the same time, the outputs associated with those systems 300, 600 may be related to the frequencies of their applied test signals. Accordingly, utilization of frequency filtering procedures (e.g., band pass filters, notch filters digital signal processing, spectral analysis etc.) may allow for separating outputs of the two systems 300, 600. Such a system may be considered analogous to a frequency division multiplexing scheme.

Irrespective of which system 300, 600 or 900 is utilized to provide an indication of the position of the actuator 112 relative to the patient's auditory component (e.g., the incus 120), it is preferable to optimize the interconnection between the actuator 112 and the auditory component. As noted above in relation to FIGS. **4*a*-4*d*, during implantation, a surgeon moves the transducer and actuator relative to the patient's skull (i.e., relative to mounting apparatus 116) to achieve proper loading between the actuator 112 and the incus 120**. Proper loading allows for efficient transfer of energy without affecting residual hearing that may be caused by excessive loading that may result in stiffening of the ossicular chain.

Proper placement of the actuator 112 is an important factor in providing the optimal benefit for the patient. If the distal tip of the actuator 112 does not touch the bottom of the hole 114, transfer of vibration will be insufficient, resulting in elevated implant thresholds and insufficient gain. In contrast, if the distal tip of the actuator 112 is advanced too far, the ossicular chain may be overloaded or stiffened, resulting in a pronounced airbone gap or loss of residual hearing or potentially insufficient vibration transfer as well.

Figure 11:
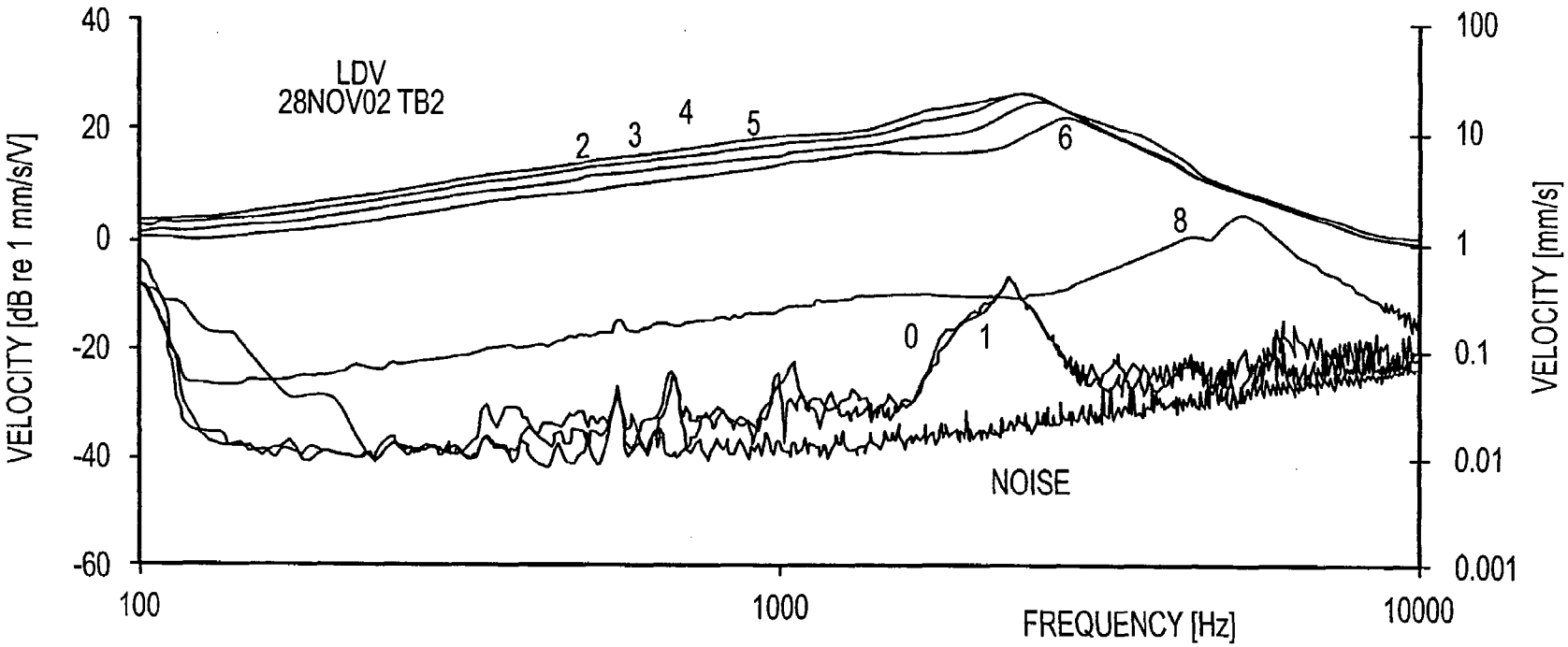
FIG. 11 illustrates a plot showing vibration transfer function associated with multiple actuator positions.
Figure 12:
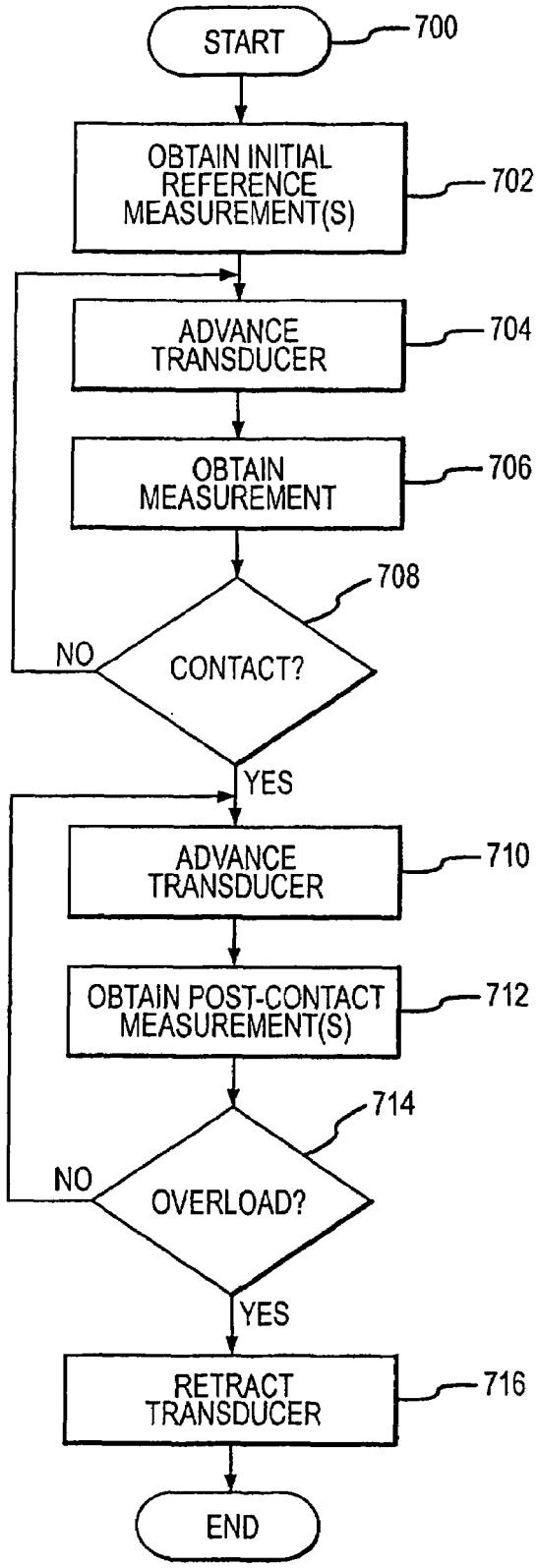
FIG. 12 illustrates example of an operational protocol for loading an auditory component.

FIG. 11 illustrates various load levels between the actuator 112 and the incus. As shown, the left hand axis represents incus velocity in response to actuator velocity, which is provided on the right hand axis. The horizontal axis represents the frequency range between 100 Hz. and 10,000 Hz. To provide optimal interconnection between the actuator 112 and the incus 120 it is desirable to maximize the transfer between those members.

FIG. 11 illustrates eight transducer/actuator positions relative to the incus 20. As shown, positions 0 and 1 represent insufficient contact between the actuator 112 and the incus 110 such that transmission between the two is ineffective. Positions 2-5 each represent well loaded positions with good transfer vibration from the actuator 112 to the incus 120. Positions 6 and 7 show the beginning of transfer efficiency loss that may be accompanied by the beginning of conductive losses. Finally, position 8 represents a seriously overloaded position (see for example FIG. 4*d*) with reduced transfer efficiency and substantial airbone gap within the ossicular chain. Accordingly, it is desirable to provide output that allows a surgeon, during implantation, to identify a transducer position(s) that maximizes vibration between the actuator 112 and the incus 120 (e.g., positions 2-5).

FIG. 8 in conjunction with FIG. 1 illustrate a process (700) for optimizing the loading between an actuator 112 and incus 120 of a patient utilizing the combined system 900 discussed in relation to FIG. 10. However, it will be noted that aspects of the process (700) may be utilized with individual systems 300 and 600 as well. First, an initial reference measurement is (702) at an actuator position that is not in contact with the incus 120. In this regard, after the transducer 108 has been placed in the mounting apparatus 116, but prior to the actuator 112 being bought into contact, the reference measurement is obtained (702). In this regard, surgeon may initiate one or both measurement systems 300, 600 to obtain position indications from the two measurement systems 300, 600. Once the reference measurements are obtained, the transducer 108 may be advanced (704) relative to the mounting apparatus 116. As will be appreciated, care will be taken to carefully align the distal tip of the actuator 112 with the laser hole 114 during this process. Typically, the transducer 108 will be advanced (704) at predetermined increments that correspond with different positions of the actuator 112 relative to the incus 120. Additional measurements may be obtained (706) by each system 300, 600 after advancement (704). A determination (708) is made as to whether contact has been made between the actuator 112 and the incus 120. If no contact is made, the transducer 108 is further advanced (704).

FIG. 13*a* shows one exemplary output that may be provided on the output device of the combined system 900. As shown, the exemplary output provides a range for each the acoustical readings and the electrical readings from the acoustical measurement system 300 and electrical measurement system 600, respectively. If the current readings are below the "No Contact" range for each system 300, 600 the transducer 108 may be further advanced (704). Also included in the output is an "Indeterminate" range. This Indeterminate range indicates a change between the reference measurement (s) and a subsequent measurement. However, this change is not of a magnitude to explicitly indicate contact between the actuator 112 and the incus 120. If one of the readings is in the Indeterminate range the other reading may be utilized. If both readings are in the Indeterminate range, visual inspection may be utilized to determine contact between the actuator 112 and incus 120. In any case, the actuator 112 is advanced (704) until at least one or both of the acoustic reading and electrical reading are in the "Contact" range.

Once contact is made, the transducer is further advanced (710) in small increments while obtaining acoustic and electrical measurements (712) at each increment. This further advancement is performed until an overloaded condition is determined (714). FIG. 13*b* shows a second exemplary output wherein loading ranges for the acoustical and electrical readings are provided. The loading ranges allow for determining "No Overload," "Indeterminate Overload" and "Overload" conditions. In this regard, the transducer 108 and hence the actuator 112 are advanced (710) until an Overload condition is indicated for at least one system 300, 600. See for example FIG. 4*d* and position 8 of FIG. 9. Once such an overload condition is present, the transducer 108 and actuator 112 may be retracted (716) a predetermined amount from the overload position. In one embodiment, the combined system 900 may provide indications that allow a user to maximize the vibration transfer between the actuator 112 and incus 120. That is, by obtaining the plurality of measurements from a non-contact position through overload, the system 900 may be operative to determine the position of the transducer 108 and actuator 112 having the highest vibration transfer to the auditory component. Accordingly, an output may be provided that allows a user to adjust the transducer 108 and actuator 112 to such a position.

The invention claimed is:

1. A method for assessing a position of an actuator of an implantable hearing instrument transducer relative to an auditory component of a patient, comprising:

transmitting at least one acoustic test signal to an ear canal of a patient;

receiving at least one reflected acoustic signal from the ear canal of the patient in response to said transmitting step; and, assessing a position of an actuator of an implantable hearing instrument transducer relative to an auditory component of the patient using the at least one reflected acoustic signal.

2. The method of claim 1, wherein the assessing step comprises:

using the at least one reflected acoustic signal to obtain at least one acoustic test measure; and, comparing the at least one acoustic test measure to at least one acoustic reference measure to obtain a first type of actuator position indication.

3. The method of claim 2, further comprising:

outputting said first type of actuator position indication to a user.

4. The method of claim 2, further comprising:

positioning the actuator of the implantable hearing instrument transducer relative to the auditory component of the patient in conjunction with said assessing step.

5. The method of claim 4, further comprising:

completing said transmitting and receiving steps successively for a plurality of times with said actuator positioned at a corresponding plurality of different positions relative to the auditory component of the patient, wherein said at least one acoustic reference measure is obtained one of said plurality of times and said at least one acoustic test measure is obtained a subsequent one of said plurality of times.

6. The method of claim 5, further comprising:

locating said actuator in an initial position relative to the auditory component of the patient, wherein the actuator is spaced from said auditory component in said initial position, and wherein said at least one acoustic reference measure is obtained with said actuator in said initial position.

7. The method of claim 6, wherein said positioning step includes:

moving said actuator from said initial position to another position relative to the auditory component of the patient, wherein said at least one acoustic test measure is obtained with said actuator in said another position.

8. The method of claim 5, wherein said at least one acoustic reference measure and said at least one acoustic test measure each represent at least one of a phase and a magnitude of a transfer function between said at least one acoustic test signal and said at least one reflected acoustic signal with said actuator positioned at different ones of said plurality of different positions relative to the auditory component of the patient.

9. The method of claim 8, wherein said assessing step further comprises:

calculating said transfer function in corresponding relation to each of said different ones of said plurality of different positions of said actuator relative to the auditory component of the patient.

10. The method of claim 8, wherein said completing step includes:

identifying a change in said transfer function to obtain said first type of actuator position indication in corresponding relation to each of the said different ones of said plurality of different positions of said actuator relative to the auditory component of the patient.

11. The method of claim 10, wherein in relation to each of said plurality of different positions of said actuator, said completing step comprises:

transmitting a plurality of acoustic test signals at different frequencies across a predetermined frequency range to the ear canal of the patient to stimulate the auditory component of the patient; and, receiving a corresponding plurality of reflected acoustic signals from the ear canal of the patient in response to the plurality of transmitted acoustic test signals.

12. The method of claim 11, wherein said predetermined frequency range encompasses a predetermined resonant frequency of said implantable hearing instrument transducer.

13. The method of claim 10, wherein said at least one acoustic test signal comprises at least one of a group comprising:

a single frequency tone;

a multi-frequency tone; and a swept frequency tone.

14. The method of claim 5, wherein said outputting step includes one of:

visually providing said first type of actuator position indication; and, aurally providing said first type of actuator position indication.

15. The method of claim 5, further comprising:

positioning a probe within the ear canal of the patient, wherein said at least one acoustic test signal is transmitted from and said at least one reflected acoustic signal is received by said probe.

16. The method of claim 15, wherein said probe is maintained at a substantially fixed position within said ear canal throughout said positioning and completing steps.

17. The method of claim 15, wherein said probe comprises or is acoustically interconnected to an acoustic signal source, and wherein said probe comprises or is acoustically interconnected to an acoustic signal receiver.

18. The method of claim 1, further comprising:

applying at least one test drive signal to the implantable hearing aid instrument transducer;

obtaining at least one transducer test measure indicative of an electrical signal passing through the actuator of the implantable hearing instrument transducer in response to said applying step; and, evaluating the position of the actuator of the implantable hearing instrument transducer relative to the auditory component of the patient utilizing said at least one transducer test measure.

19. The method of claim 18, wherein the evaluating step comprises:

comparing the at least one transducer test measure to at least one transducer reference measure to obtain a second type of actuator position indication.

20. The method of claim 19, further comprising:

outputting said second type of actuator position indication to a user.

21. The method of claim 20, further comprising:

positioning the actuator of the implantable hearing instrument transducer relative to the auditory component of the patient in conjunction with at least one of said assessing and evaluating steps.

22. The method of claim 21, further comprising:

completing said transmitting and receiving steps, and said applying and obtaining steps, in timed relation for a plurality of times with said actuator positioned at a corresponding plurality of different positions relative to the auditory component of the patient, wherein said at least one acoustic reference measure is obtained one of said plurality of times, and wherein said at least one acoustic test measure and said at least one transducer test measure are obtained at a subsequent one of said plurality of times.

23. The method of claim 22, wherein in relation to each of said plurality of different positions of said actuator, said completing step comprises:

transmitting a plurality of acoustic tests signals at different frequencies across a first predetermined frequency range to the ear canal of the patient, and receiving a corresponding plurality of reflected acoustic signals from the ear canal of the patient in response to the plurality of transmitted acoustic test signals; and, applying a plurality of test drive signals at different frequencies across a second predetermined frequency range to the implantable hearing instrument transducer, and obtaining a corresponding plurality of transducer test measures each indicative of an electrical signal passing through the transducer in response to said plurality of transmitted test drive signals.

24. The method of claim 23, wherein in relation to each of said plurality of different positions of said actuator said first type of actuator position indication and second type of actuator position indication are output to a user.

25. The method of claim 24, wherein said actuator said first type of actuator position indication and second type of actuator position indication are output in relation to an acoustic indication range and a transducer test measure indication range.

26. The method of claim 24 wherein said positioning the actuator of the implantable hearing instrument transducer relative to the auditory component of the patient comprises positioning the actuator such that at least one of:

said first indication is in a predetermined portion of said acoustic indication range; and said second indication is in a predetermined portion of said transducer test measure indication range.

27. The method of claim 23, wherein said transmitting step and said applying step are performed sequentially at temporally separate times.

28. The method of claim 23, wherein said transmitting step and said applying step at least partially overlap.

29. The method of claim 28, wherein said first predetermined frequency range and said second predetermined frequency range do not overlap.

* * * * *

UNITED STATES PATENT AND TRADEMARK OFFICE

CERTIFICATE OF CORRECTION

PATENT NO. : 7,582,052 B2
APPLICATION NO. : 11/115436
DATED : September 1, 2009
INVENTOR(S) : Bernd Waldmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1079 days.

Signed and Sealed this

Fourteenth Day of September, 2010

David J. Kappos

David J. Kappos
*Director of the United States Patent and Trademark Office*